US011219344B2

(12) United States Patent
Ko

(10) Patent No.: US 11,219,344 B2
(45) Date of Patent: Jan. 11, 2022

(54) ROBOT VACUUM CLEANER

(71) Applicant: LG Electronics Inc., Seoul (KR)

(72) Inventor: Moohyun Ko, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 335 days.

(21) Appl. No.: 16/343,045

(22) PCT Filed: Oct. 18, 2017

(86) PCT No.: PCT/KR2017/011556
§ 371 (c)(1),
(2) Date: Apr. 18, 2019

(87) PCT Pub. No.: WO2018/074852
PCT Pub. Date: Apr. 26, 2018

(65) Prior Publication Data

US 2020/0046185 A1 Feb. 13, 2020

(30) Foreign Application Priority Data

Oct. 19, 2016 (KR) ..... 10-2016-0135506

(51) Int. Cl.
*A47L 9/06* (2006.01)
*A47L 7/00* (2006.01)
*A47L 11/40* (2006.01)

(52) U.S. Cl.
CPC ..... *A47L 9/0686* (2013.01); *A47L 7/0004* (2013.01); *A47L 11/4083* (2013.01); *A47L 2201/00* (2013.01)

(58) Field of Classification Search
CPC .... A47L 7/0004; A47L 7/0028; A47L 7/0042; A47L 11/28; A47L 11/284; A47L 11/408;
(Continued)

(56) References Cited

U.S. PATENT DOCUMENTS 7,226,035 B2 * 6/2007 Kimura ..... B41J 2/17509 251/129.17
8,382,906 B2 * 2/2013 Konandreas ..... A22C 17/0013 134/6

(Continued)

FOREIGN PATENT DOCUMENTS

| | | |
|---|---|---|
| CN | 204654821 | 9/2015 |
| CN | 204909318 | 12/2015 |
| CN | 205064303 | 3/2016 |
| CN | 205306905 | 6/2016 |

(Continued)

OTHER PUBLICATIONS

Machine translation of KR-101014468-B1 (Year: 2010).*
International Search Report dated Oct. 18, 2017.

(Continued)

*Primary Examiner* — Shay Karls
*Assistant Examiner* — Robert F Neibaur
(74) *Attorney, Agent, or Firm* — Finnegan, Henderson, Farabow, Garrett & Dunner, LLP

(57) ABSTRACT

A robot vacuum cleaner includes a main body that moves along a surface, draws in dust from the surface, filters the dust, and discharges air. A water tank is detachably mounted on a lower surface of the main body, and a damp cloth is mounted to the water tank. The water tank stores water in a filling space and supplies water from the filling space through a water supply unit mounted on a lower surface of the water tank to the damp cloth. An air inlet is formed on an upper surface of the water tank. An air inflow member selectively opens the air inlet to allow outside air to flow into the filling space when the main body moves, and closes the air hole when the main body stops moving.

20 Claims, 18 Drawing Sheets

(58) Field of Classification Search
CPC ..... A47L 11/4083; A47L 11/4088; A47L 13/22; A47L 2201/00–06
USPC ..... 15/319, 320
See application file for complete search history.

(56) References Cited

U.S. PATENT DOCUMENTS

| | | | | |
|---|---|---|---|---|
| 8,898,844 | B1 * | 12/2014 | Dooley | A47L 11/408 15/98 |
| 9,265,396 | B1 * | 2/2016 | Lu | A47L 11/4083 |
| 9,357,894 | B2 * | 6/2016 | Chiu | A47L 11/4002 |
| 2009/0159823 | A1 * | 6/2009 | Matsunaga | F16K 11/07 251/129.15 |

FOREIGN PATENT DOCUMENTS

| | | | |
|---|---|---|---|
| EP | 2730204 | | 5/2014 |
| KR | 10-1997-0024427 | | 6/1997 |
| KR | 100233369/970061176 | | 9/1997 |
| KR | 20-1998-016009 | | 6/1998 |
| KR | 10-2010-0026279 | A | 3/2010 |
| KR | 20100076134 | | 7/2010 |
| KR | 10-1014468 | B1 | 2/2011 |
| KR | 10-2011-0105305 | A | 9/2011 |
| KR | 10-1352195 | B1 | 1/2014 |
| KR | 10-2015-0014351 | A | 2/2015 |

OTHER PUBLICATIONS

Notice of Allowance of KR 10-2016-0135506.
European Search Report dated May 29, 2020.

* cited by examiner

ROBOT VACUUM CLEANER

CROSS-REFERENCE TO RELATED APPLICATIONS

This application is a U.S. National Phase entry under 35 U.S.C. § 371 from PCT International Application No. PCT/KR2017/011556, filed Oct. 18, 2017, which claims the benefit of priority of Korean Patent Application No. 10-2016-0135506, filed Oct. 19, 2016, all of which are incorporated herein by reference in their entireties.

TECHNICAL FIELD

The present invention relates to a robot vacuum cleaner.

BACKGROUND ART

In general, cleaners are home appliances that suction and remove foreign matters on the bottom surface. Among the cleaners, a cleaner that automatically performs cleaning is called a robot vacuum cleaner. The robot vacuum cleaner suctions and removes foreign matters on the bottom surface while moving by driving force of a motor that operates by a rechargeable battery.

In recent years, a robot vacuum cleaner having constituents for suctioning foreign matters as well as wiping a bottom surface has been introduced. Also, a robot vacuum cleaner that allows water to be supplied to a constituent for wiping so that the water performs overall cleaning without being dried has been introduced.

A robot vacuum cleaner in which a mop plate configured to supply water is provided at a lower portion of a rear side of a robot body, and a damp cloth is provided on a lower portion of the mop plate so that water is continuously supplied to the damp cloth is disclosed in Korean Patent Publication No. 10-2015-0014351.

However, in the above-described related art, a water supply part for supplying water to a bottom surface of the mop plate contacting the damp cloth is provided, but an air hole for introducing air into a water tank is not formed. Thus, when the water is supplied to the damp cloth through the water supply part, air may not be smoothly supplied into the water tank. Thus, an air pressure inside the water tank decreases, the water may not be smoothly supplied.

In the above-described related art, when the air hole is formed in the mop plate, the air pressure inside the water tank increases so that the water is smoothly supplied. However, even when the robot vacuum cleaner is stopped, and thus, the cleaning is not performed, the water may be continuously supplied, and thus, the floor may be wet, and the water may be unnecessary consumed.

DISCLOSURE OF THE INVENTION

Technical Problem

An object of the present invention is to provide a robot vacuum cleaner in which water is prevented from being supplied to a damp cloth in a state in which the robot vacuum cleaner is stopped because a water tank unit on which the damp cloth is mounted and in which water to be supplied to the damp cloth is stored is provided.

An object of the present invention is to provide a robot vacuum cleaner in which water within a water tank unit is stably supplied to damp cloth when the robot vacuum cleaner for cleaning operates.

An object of the present invention is to provide a robot vacuum cleaner in which an air hole for adjusting an air pressure within a water tank unit is formed to prevent the air hole from being blocked by foreign matters or scales.

Technical Solution

A robot vacuum cleaner according to an embodiment of the present invention includes: a main body running along a surface to be cleaned, the main body being configured to suction and filter dusts on the surface to be cleaned and then discharge air; a water tank unit which is detachably mounted on a bottom surface of the main body and on which a damp cloth is mounted; a filling space formed in the water tank unit, the filling space being configured to store water to be supplied to the damp cloth; a water supply unit mounted on a bottom surface of the water tank unit, the water supply unit being configured to supply the water within the filling space to the damp cloth; an air inlet which is formed in a top surface of the water tank unit and in which an air hole through which external air is introduced into the filling space is formed; and an air inflow control member configured to open the air hole when the main body runs and cover the air hole when the main body is stopped.

Also, the air inlet may include a recess part that is recessed from a top surface of the water tank unit into the filling space, and the air hole may be formed in a lower end of the recess part.

Also, the recess part may extend up to a position adjacent to a bottom surface of the filling space.

Also, the air inlet may further include a recess part stopper configured to cover an opened top surface of the recess part, and an inflow hole through which the external air is introduced into the recess part may be formed in the recess part stopper.

Also, the air inflow control member may include: an electromagnet provided in the main body to generate magnetic force by supplying power when the main body runs; and a hole switching member configured to open and close the air hole by vertical movement of the recess part, the hole switching member moving upward when the magnetic force of the electromagnet is generated to open the air hole.

Also, a detection device configured to detect mounting of the water tank unit may be provided in the main body, and when the main body may operate in the state in which the water tank unit is mounted on the main body, the power is supplied to the electromagnet.

Also, the hole switching member may have a height less than a depth of the recess part.

Also, the recess part may have a diameter that gradually decreases downward from an upper side, and the hole switching member may have a spherical shape and is formed with a diameter corresponding to a lower diameter of the recess part.

Also, the hole switching member may have a plate shape, a plurality of ribs configured to guide the vertical movement of the hole switching member may protrude from an inner surface of the recess part, and the plurality of ribs may be spaced apart from each other along a circumference of the inner surface of the recess part to extend in a vertical direction.

Also, at least a portion of the inflow hole may be disposed further outward than the hole switching member.

Also, the inflow hole may be formed at a position corresponding to a spaced space between the ribs adjacent to each other.

Also, a sealing member may be disposed on a bottom surface of the hole switching member, and the sealing member may have a shape corresponding to a bottom surface of the recess part.

Also, the air inflow control member may include a hole switching member provided in the recess part, having a diameter less than that of the recess part, and having a spherical shape, wherein the air inflow control member may be disposed on a top surface of the air hole to cover the air hole in a state in which the main body is stopped and moves to a side of the air hole to open the air hole by inertia caused by acceleration force of the main body when the main body runs.

Also, the bottom surface of the recess part may be inclined downward toward a center thereof, and the air hole may be formed in the center of the bottom surface of the recess part.

Also, the air inflow control member may include a solenoid valve provided in the main body, wherein the solenoid valve may include: a valve body provided in the main body, valve body being configured to generate magnetic fields by supplying power in a state in which the main body is stopped; and a shaft withdrawn from the valve body by the magnetic fields and passing through a bottom surface of the main body when being withdrawn so as to be inserted into the recess part.

Also, a gasket may be disposed on an end portion of the shaft, and the gasket may contact a bottom surface of the recess part to cover the air hole in a state in which the shaft is inserted into the recess part.

Also, the shaft may be disposed vertically above the recess part and have a movable shaft that is perpendicular to the recess part.

Also, a detection device configured to detect mounting of the water tank unit may be provided in the main body, and when the main body is stopped in the state in which the water tank unit is mounted on the main body, power may be supplied to the solenoid valve.

Also, a water injection hole configured to supply water into the filling space may be formed in an end portion of one side on a top surface of the water tank unit, and the air inlet may be disposed at a position adjacent to the water injection hole.

Also, at least a portion of the water supply unit may be exposed to the inside of the filling space and a bottom surface of the water tank unit, the water supply unit may absorb water within the filling space to transfer the water to the damp cloth, and an amount of water to be supplied may be controlled by adjusting an air pressure of the filling space through the opening and closing of the air hole.

Advantageous Effects

The robot vacuum cleaner according to the embodiments may have the following effects.

First, the filling space in which the water to be supplied to the damp cloth is stored may be formed in the water tank unit, and the air inlet having the air hole through which the external air is introduced into the filling space may be provided in the water tank unit. Also, the air inflow control member in which the air hole may be opened when the main body for the cleaning runs, and the air hole is coved when the main body is stopped may be provided. Due to the above-described characteristics, when the main body for the cleaning operates, the external air may be introduced into the filling space through the air hole so that the water is stably supplied to the damp cloth. When the main body is stopped, the introduction of the external air through the air hole may be blocked to block the supply of the water to the damp cloth. Thus, the wetting of the bottom may be prevented in the state in which the main body is stopped, and the supply of the water in the unnecessary situation may be prevented to significantly reduce the use time of the water.

Second, the air inlet may include the recess part that is recessed from the top surface of the water tank unit to the inside of the filling space, and the air hole may be formed in the lower end of the recess part. Due to the above-described characteristics, the air hole may be blocked by the water in the state in which the water is sufficiently filled in the filling space. Thus, when the air pressure within the filling space is reduced, the external air may be introduced by the difference in air pressure through the air hole. Also, when the amount of water in the filling space is less, the air hole may not be blocked by the water but be opened. Thus, when the amount of water in the filling space is much, the air pressure within the filling space may be adjusted to be lowered to stably adjust the amount of water supplied to the damp cloth. Also, when the amount of water in the filling space is less, the external air may be smoothly introduced into the filling space to smoothly supply the water to the damp cloth, thereby effectively using the remaining water.

Third, since the air inlet is formed in the top surface of the water tank unit, the air inlet may be prevented from being blocked by the foreign matters and the scales. Thus, the operation reliability of the water tank unit may be secured.

Fourth, the detection device detecting the mounting of the water tank unit may be provided in the main body. Also, when the air inflow control member includes the electromagnet or the solenoid valve, the power supplied to the electromagnet or solenoid valve may be supplied only when the water tank unit is mounted on the main body. Thus, when the water tank unit is mounted to perform the water cleaning, the power supplied to the electromagnet or the solenoid valve may be blocked to prevent the power from being unnecessarily consumed.

Fifth, when the water injection hole for supplying the water into the filling space is formed in the top surface of the water tank unit, the water injection hole may be formed in the end of one side of the top surface of the water tank unit. Also, the air inlet may be formed on the end of the one side of the top surface of the water tank unit in which the water injection hole is formed. Thus, when the water is filled in the state in which the water tank unit is inclined so that the water injection hole is disposed at the upper side, the air hole may be sunken in the water until the water is maximally filled to prevent the water from leaking through the air hole. Thus, the water may be stably filled into the water tank unit to improve the use satisfaction of the user.

BRIEF DESCRIPTION OF THE DRAWINGS

FIG. 4 is viewed from a lower side.

MODE FOR CARRYING OUT THE INVENTION

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
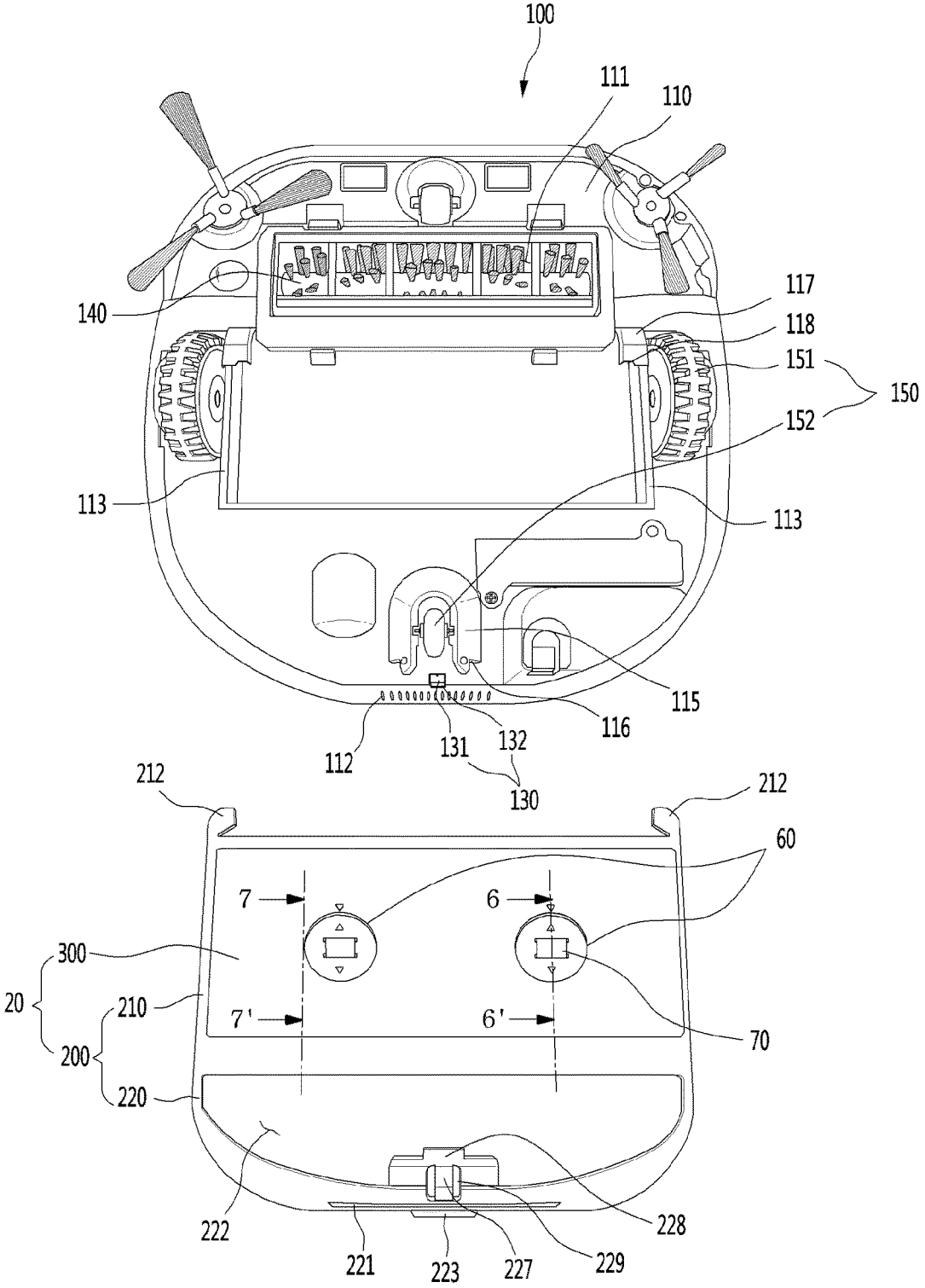
FIG. 1 is a perspective view illustrating a state in which a water tank unit of a robot vacuum cleaner is mounted on a main body according to an embodiment of the present invention.
Figure 2:
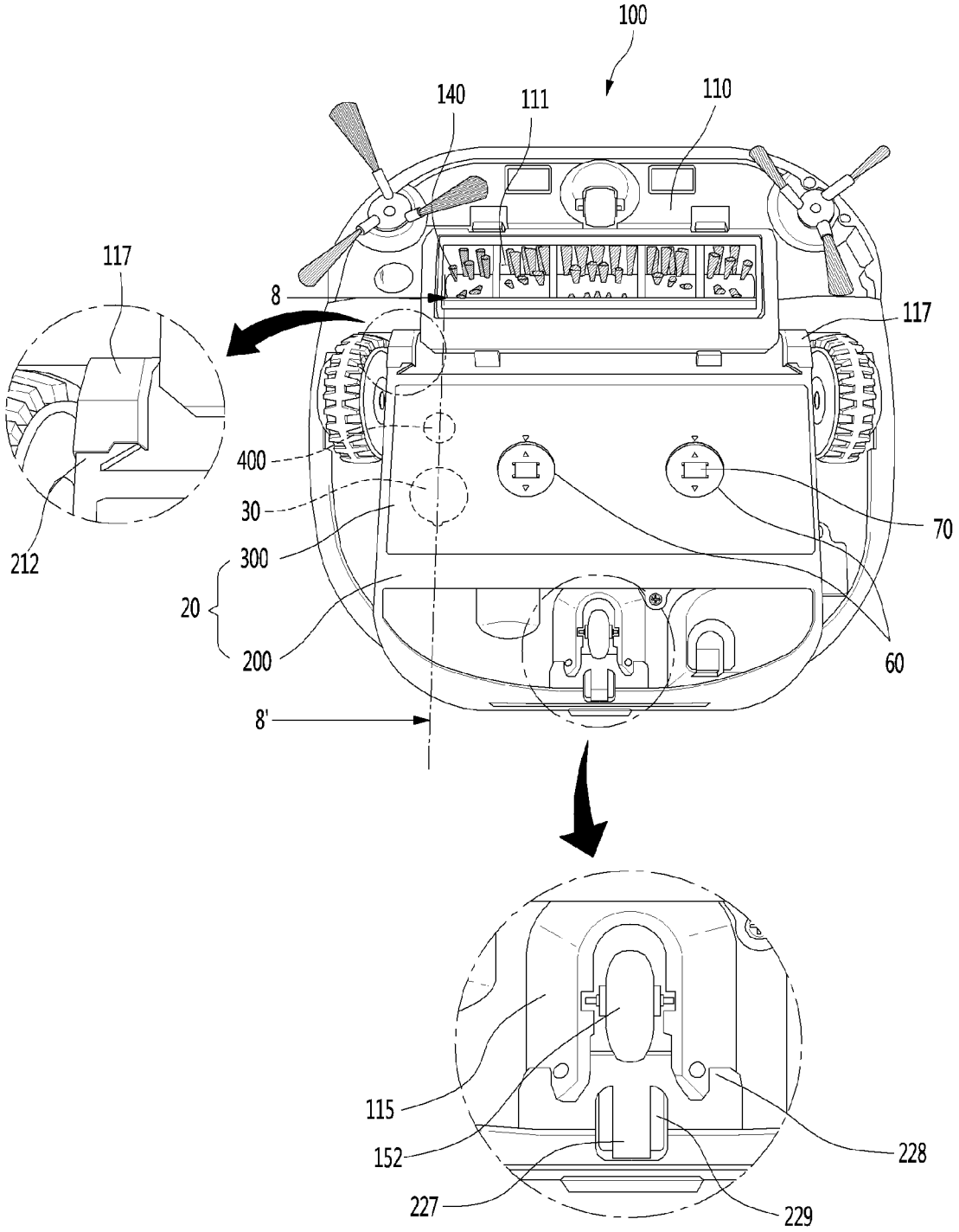
FIG. 2 is a perspective view illustrating a state in which the water tank unit of the robot vacuum cleaner is mounted on the main body according to an embodiment of the present invention.

FIG. 1 is a perspective view illustrating a state in which a water tank unit of a robot vacuum cleaner is mounted on a main body according to an embodiment of the present invention, and FIG. 2 is a perspective view illustrating a state in which the water tank unit of the robot vacuum cleaner is mounted on the main body according to an embodiment of the present invention.

A main body 110 of a robot vacuum vacuum cleaner 100 may have an approximately polyhedral shape including a top surface, a bottom surface, and edge surfaces. Hereinafter, for convenience of description, the edge surfaces of the main body 110, which correspond to front and rear portions in a running direction of the main body 110 may called front and rear surfaces of the main body 110, respectively. Also, the edge surfaces of the main body 110, which are disposed between the front and rear surfaces of the main body 110 are called side surfaces.

A nozzle opening 111 may be formed in the bottom surface of the main body 110. The nozzle opening 111 may be defined as a portion through which air containing foreign matters is suctioned into the main body 110. Also, the nozzle opening 111 may be formed by cutting a portion of a front portion of the bottom surface of the main body 110.

A discharge hole 112 may be formed in one side of the edge surface of the main body 110. The discharge hole 112 may be defined as a portion through which the suctioned into the main body 110 is discharged to the outside of the main body 110 in a state in which the foreign matters are filtered. In this embodiment, the discharge hole 112 may be disposed at one side of the rear surface of the main body 110.

A suction device may be provided in the main body 110. Also, the suction device may provide suction force to suction the air containing the foreign matters through the nozzle opening 111 and discharge the air, through which the foreign matters are filtered, through the discharge hole 112.

Also, an agitator 140 may be provided in the main body 110. The agitator 140 may be installed in the main body to correspond to an upper side of the nozzle opening 111. The agitator 140 may serve to remove the foreign matters from an object to be cleaned through the nozzle opening 111.

Also, a wheel 150 for moving the robot vacuum cleaner 100 may be provided on the main body 110. The wheel 150 may include a driving wheel 151 and an auxiliary wheel 152. The driving wheel 151 may rotate by driving force provided from a driving motor so that the main body 110 is run. Also, the auxiliary wheel 152 may be rolled by the running of the main body 110 and support the main body 110 at a position that is spaced apart from the driving wheel 151.

A pair of guide ribs 113 may be disposed on the bottom surface of the main body 110. The guide ribs 113 may serve to guide movement of a water tank unit 20 when the water tank unit 20 is attached to or detached from the main body 110. The guide ribs 113 may be disposed to be spaced apart from each other on left and right sides of the bottom surface of the main body 110 to lengthily extend forward and backward from the bottom surface of the main body 110.

Here, in the pair of guide ribs 113, a distance between rear ends may be relatively greater than that between front ends so that the water tank unit 20 is easily inserted. Thus, the water tank unit 20 may be guided by the pair of guide ribs 113 and thus be mounted at a proper position of the main body 110.

A first fixing part 115 and a second fixing part 117, which restrict the forward movement of the water tank unit 20 may be disposed on the bottom surface of the main body 110.

The first fixing part 115 may have a ㅁ or ㅈ shape by allowing a portion of the main body 110 to protrude downward. The first fixing part 115 may be disposed at a rear end of the main body, which corresponds to a rear side of a rear end of each of the guide ribs 113.

The first fixing part 115 may be disposed at a center of a horizontal width of the main body 110. Also, the auxiliary wheel 152 may be rotatably mounted on the first fixing part 115. Here, the auxiliary wheel 152 may further protrude downward from the first fixing part 115. Thus, when the water tank unit 20 is slid to be mounted on the main body 110, frictional force between the water tank unit 20 and the main body 110 may be reduced by contacting the water tank unit 20 so that the water tank unit 20 smoothly moves.

Also, a first fixing slot 116 into which the fixing rib 228 of the water tank unit 20 is inserted and fixed when the water tank unit 20 moves forward along the guide ribs 113 may be formed in the first fixing part 115. The first fixing slot 116 may be formed to be opened backward by being recessed from one side of the first fixing part 115 so that the fixing rib 228 of the water tank unit 20 is inserted.

The second fixing part 117 may be formed by allowing a portion of the main body 110 to protrude downward. The second fixing part 117 may be disposed at a front side of the front end of the guide rib 113. Here, the second fixing part 117 may be provided in a pair that are spaced apart from each other in both left and right directions and respectively disposed at front sides of the pair of guide ribs 113.

A second fixing slot 118 into which a hook protrusion 212 of the water tank unit 20 is inserted and fixed when the water tank unit 20 moves forward along the guide ribs 113 may be formed in the second fixing part 117. The second fixing slot 118 may be formed to be opened backward by being recessed from one side of the second fixing part 117 so that the hook protrusion 212 of the water tank unit 20 is inserted.

When the fixing rib 228 and the hook protrusion 212 are inserted into the first fixing part 115 and the second fixing part 117, the forward movement of the water tank unit 20 may be restricted, and also, the water tank unit 20 may be disposed at an accurate mounting position.

A restriction part 130 for restricting the water tank unit 20 to prevent the water tank unit 20 from being separated in the state in which the fixing rib 228 and the hook protrusion 212 are inserted into the first fixing part 115 and the second fixing part 117 may be formed on the bottom surface of the main body 110.

The restriction part 130 may be defined as a portion into which a restriction rib 227 of the water tank unit 20 is inserted to be hook-restricted. The restriction part 130 may be disposed behind the first fixing part 115 and also be disposed at a center in a horizontal direction of the main body 110.

The restriction part 130 may include an input/output opening 132 into which the restriction rib 227 is inserted to be hook-restricted and a movable member 131 that is vertically movable inside the input/output opening 132 when the water tank unit 20 slidably moves forward along the guide ribs 113.

The input/output opening 132 may be formed by being recessed from the bottom surface of the main body 110. Also, a rear end of the input/output opening 132 may be inclined to guide the input and output of the restriction rib 227.

The restriction rib 227 may be provided to be elastically deformable on one side of the water tank unit 20. Thus, when the water tank unit 20 moves forward and backward, the restriction rib 227 may be elastically deformed to be selectively hook-restricted on the input/output opening 132.

An elastic member may be provided inside the movable member 131. Thus, when the restriction rib 227 is inserted into the input/output opening 132, the movable member 131 may move upward. Also, when the restriction rib 227 is separated from the input/output opening 132, the movable member 131 may move downward by elastic force of the elastic member. Here, a lower end of the movable member 131 may move downward to be located at the same height as a lower end of the input/output opening 132.

A detection device detecting whether the water tank unit 20 is mounted may be provided in the main body 110. The detection device may be disposed inside the input/output opening 132, and the movable member 131 may provide a function of a button for the detection of the detection device. For example, a switch for detecting the mounting of the water tank unit 20 may be provided inside the input/output opening 132, and the switch may operate by the vertical movement of the movable member 131. Thus, the robot vacuum cleaner 100 may provide different operation modes according to whether the water tank unit 20 is mounted.

The water tank unit 20 may be detachably provided on the main body 110, and a damp cloth may be installed on the water tank unit 20. Also, a filling space (see reference numeral 60 of FIG. 6) into which water to be supplied to the damp cloth may be formed in the water tank unit 20.

As illustrated in FIG. 1, the water tank unit 20 may have a shape that matches a portion of the bottom surface and a portion of the rear surface of the main body 110.

The water tank unit 20 may have an overall shape by coupling of an upper member 200 and a lower member 300.

In detail, the upper member 200 may be provided to form an upper structure of the water tank unit 20. Also, the upper member 200 may be divided into a water tank formation part 210 coupled to the lower member 300 to form the filling space 50 and a manipulation part 220 manipulated by a user to detach the water tank unit 20. Here, a region of the water tank unit 20, in which the filling space 50 is formed, may be defined as a water tank part.

A recessed space may be formed in a bottom surface of the water tank formation part 210, and the lower member 300 may be formed to cover the recessed space of the bottom surface of the water tank formation part 210. Thus, the filling space 50 may be formed between the water tank formation part 210 and the lower member 300.

The manipulation part 220 may not be provided as a portion of the upper member 200 but provided as a portion of the lower member 300. That is, the water tank part may be formed by coupling the water tank formation part 210 of the upper member 200 to the lower member 300. The manipulation part 220 may be integrated with the water tank formation part 210 or integrated with the lower member 300. In this embodiment, an example of a structure in which the manipulation part 220 is provided as a portion of the upper member 200 will be described in detail.

The filling space 50 may be formed in a front portion of the water tank unit 20, and the water tank formation part 210 may be defined as a front portion of the upper member 200. Also, the manipulation part 220 may be defined as a rear portion of the upper member 200.

The hook protrusion 212 may be formed on the water tank formation part 210. The hook protrusion 212 may be defined as a portion that is inserted into the second fixing slot 118 when the water tank unit 20 is mounted on the main body 110. That is, the hook protrusion 212 may be inserted into the second fixing slot 118 and fixed to the second fixing part 117. For this, the hook protrusion 212 may protrude forward from a front edge of the water tank formation part 210.

The manipulation part 220 may be a portion that is manipulated by the user so that the water tank unit 20 moves to the main body 110 in the horizontal direction and extend to a rear end of the water tank formation part 210. Also, the manipulation part 220 may have a shape corresponding to the rear surface of the main body in the state in which the water tank unit 20 is mounted on the main body 110 to contact the rear surface of the main body 110.

A second opening 222 may be formed between the manipulation part 220 and the water tank formation part 210. The second opening 222 may be formed by cutting a portion of the manipulation part 220 and be formed at a position corresponding to the first fixing part 115. In the state in which the water tank unit 20 is mounted on the main body 110, interference between the first fixing part 115 and the water tank unit 20 may be avoided by the second opening 222.

The fixing rib 228 may be formed on the manipulation part 220. The fixing rib 228 may be defined as a portion that is inserted into the first fixing slot 116 when the water tank unit 20 is mounted on the main body 110. That is, the fixing rib 228 may be inserted into the first fixing slot 116 and fixed to the first fixing part 115. The fixing rib 228 may be formed to protrude from one side of the manipulation part 220, which corresponds to the rear end of the second opening 222, and be lengthily formed in the horizontal direction.

The restriction rib 228 may be formed on the manipulation part 220. The restriction rib 228 may be defined as a portion that is restricted by the restriction part 130 when the water tank unit 20 is mounted on the main body 110. The restriction rib 228 may be formed to protrude upward from one side of the manipulation part 220 and be formed to be elastically deformable. In detail, the restriction rib 228 may be disposed at one side of the manipulation part 220 adjacent to the fixing rib 228. Also, to elastically deform the restriction rib 228, a cutoff part 229 may be formed in one side of the manipulation part 220 adjacent to the restriction rib 228.

A first opening 221 may be formed in the manipulation part 220. The first opening 221 may be provided so that air is discharged through the discharge hole 112 in the state in which the water tank unit 20 is mounted on the main body 110. For this, the first opening 221 may be formed by cutting a portion of the manipulation part 220, which corresponds to the discharge hole 112 in the state in which the water tank unit 20 is mounted on the main body 110.

Also, a grasp part 223 may be formed on the manipulation part 220. The grasp part 223 may be formed to protrude backward from an upper end of the manipulation part 220.

The lower member 300 may be provided to cover a lower side of the filling space 50. The lower member 300 may be coupled to the upper member 200 so that a portion of the lower member 300, which is coupled to the upper member 200, is completely sealed to prevent the water from leaking into the filling space 50.

The lower member 300 may be provided to form most portion of a region surrounded by the damp cloth on the bottom surface of the water tank unit 20. Also, the lower member 300 may be provided in a plate shape, and the bottom surface of the lower member 300 may have a completely flat plate shape. Thus, the damp cloth may be closely attached to the bottom surface of the lower member 300 in a state of being mounted on the water tank unit 20. Also, the damp cloth may be supported on the lower member 300 so as to be closely attached to the bottom, thereby cleaning the bottom.

A water supply unit for supplying water within the filling space 50 to the damp cloth may be provided in the lower member 300. The water supply unit may include a water transfer member 70 that absorbs the water within the filling space 50 to transfer the water to the damp cloth and a covering member on which the water transfer member 70 is mounted and which is mounted on the lower member 300 to provide a water supply passage.

The covering member 60 may be provided in plurality on the lower member 300. For example, the covering members 60 may be provided symmetrical to each other on both left and right sides with respect to a center of the horizontal width and respectively disposed on a pair of lines which are divided into third portions in the horizontal direction.

Figure 3:
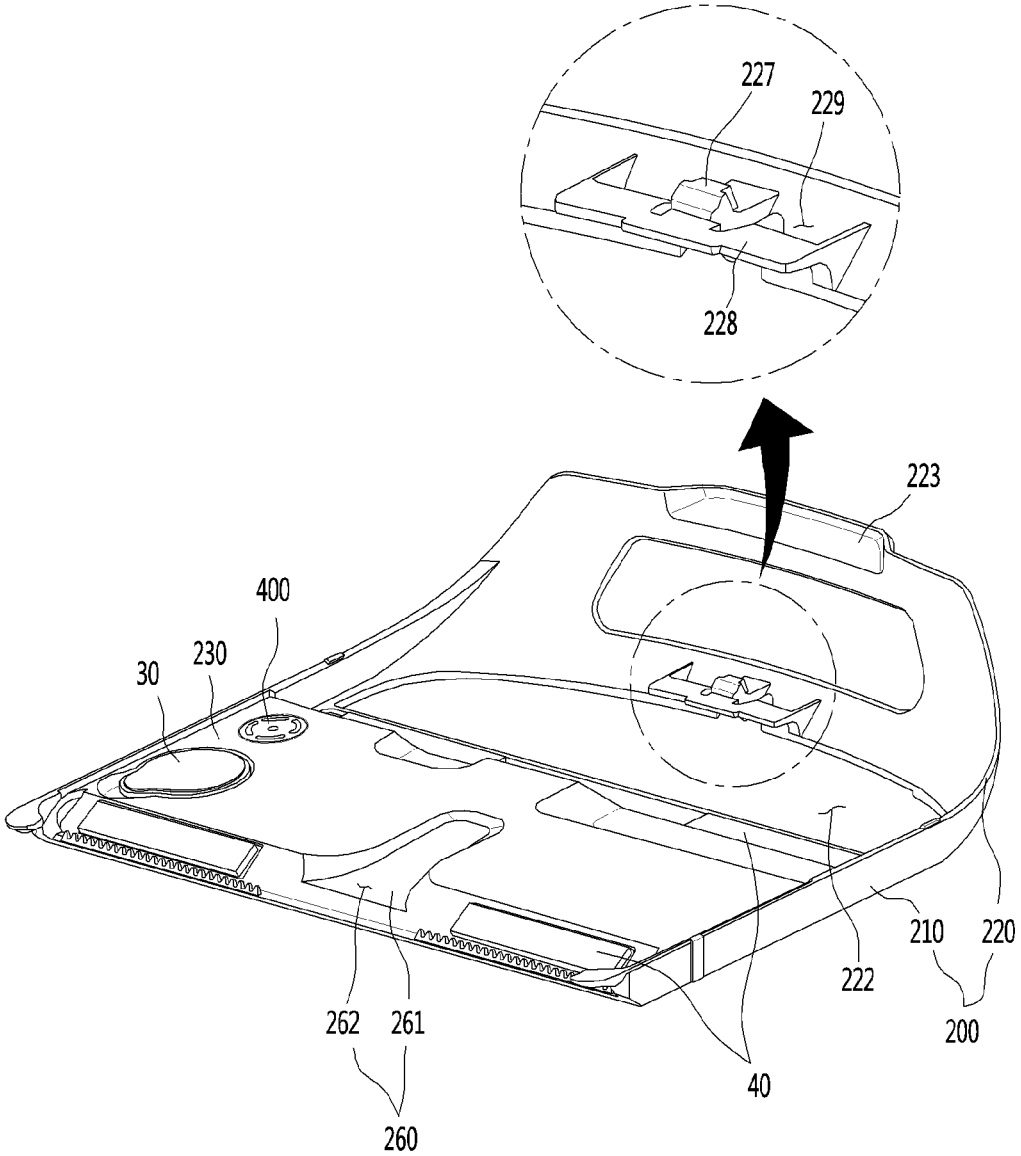
FIG. 3 is a perspective view illustrating an upper structure of the water tank unit according to an embodiment of the present invention.

FIG. 3 is a perspective view illustrating the upper structure of the water tank unit according to an embodiment of the present invention.

The manipulation part 220 may vertically extend to have a predetermined height so as to surround the rear surface of the main body 110.

The second opening 222 may be formed between the water tank formation part 210 and the manipulation part 220. Also, the fixing rib 228 may protrude from one side of the manipulation part 220, which corresponds to a rear end of the second opening 222.

Also, the restriction rib 227 may be disposed behind the fixing rib 228, and at least a portion of the restriction rib 227 may be integrated with the fixing rib 228. Also, the restriction rib 227 may further protrude upward than the fixing rib 228. Thus, when the fixing rib 228 is inserted into the first fixing part 115, the restriction rib 227 may be inserted into and restricted by the restriction part 130 disposed behind the first fixing part 115. Also, the cutoff part 229 for the elastic deformation of the restriction rib 227 may be formed in each of left and right sides of the restriction rib 227.

A damp cloth fixing member 40 for fixing the damp cloth may be provided on the top surface of the water tank formation part 210. For example, the damp cloth fixing member 40 may be a Velcro, and a relative Velcro fixed to the damp cloth fixing member 40 may be provided on the damp cloth.

The damp cloth fixing member 40 may be disposed on each of front and rear end portions of the water tank formation part 210 and also be provided in plurality, which are disposed adjacent to both left and right ends of the front and rear end portions. Thus, the user may allow the damp cloth to surround the bottom surface of the water tank unit 20 corresponding to the water tank formation part 210 and then fix both sides of the damp cloth to the damp cloth fixing member 40. Here, one side of the damp cloth may be fixed to the damp cloth fixing member 40 provided on the front end portion of the water tank formation part 210, and the other side of the damp cloth may be fixed to the damp cloth fixing member 40 provided on the rear end portion of the water tank formation part 210 after passing through the second opening 222.

Each of the front and rear end portions of the water tank formation part 210 on which the damp cloth fixing member 40 is provided may be inclined. Thus, since the damp cloth fixing member 40 is inclinedly provided, the user may more easily detach the damp cloth. Also, a plurality of protruding protrusions may be disposed on portions at which the damp cloth surrounds and contacts the bottom surface of the water tank unit 20 at the front and rear end portions of the water tank formation part 210. Thus, the damp cloth may be more firmly fixed to the water tank unit 20 by the plurality of protrusions and thus be prevented from moving.

A water injection part 230 in which a water injection hole (see reference numeral 233 of FIG. 4) punched to supply water into the filling space 50 is formed may be provided on the top surface of the water tank formation part 210. Also, a stopper 30 that opens and closes the water injection hole 233 may be provided on the water injection part 230.

The water injection hole 233 may be formed in a left end portion or a rear end portion on the top surface of the water tank formation part 210. Thus, when the water is filled into the water tank unit 20, the water tank unit 20 may be inclined so that the one end portion into which the water injection hole 233 is formed is disposed above the opposite end portion, thereby stably filling the water.

An air inlet 400 for adjusting an air pressure within the filling space 50 may be formed in the water tank formation part 210.

The air inlet 400 may be formed in the left end portion or the rear end portion on the top surface of the water tank formation part 210. Here, the air inlet 400 may be formed in an end portion in which the water injection hole 233 is formed. Thus, when the water tank unit 20 is inclined to be filled with water, the water may not contact the air inlet 400 until the water is fully filled to prevent the water from leaking through the air inlet 400.

Also, a recessed guide groove 260 may be formed in the top surface of the water tank formation part 210. When the water tank unit 20 is slid to be mounted on the main body 110, the auxiliary wheel 152 may be inserted into the guide groove 260 so that an initial mounting position of the water tank unit 20 is aligned.

In detail, the guide groove 26 may be recessed from the top surface of the water tank formation part 210 and opened forward. Also, when the water tank unit 20 is mounted at an accurate position of the main body 110, the guide groove 260 may be formed at a position corresponding to the auxiliary wheel 152. That is, the guide groove 260 may be formed at a center of a left/right width on the top surface of the water tank formation part 210. Thus, when the water tank unit 20 moves forward from a rear side so as to be mounted on the main body 110, the auxiliary wheel 152 may be inserted into the guide groove 260 through a guide opening 262 that is opened to a front side of the guide groove 260 and then move along the guide groove 260. Thus, the initial mounting position of the water tank unit 20 may be aligned by the auxiliary wheel 152 and the guide groove 260.

Also, the guide opening 262 may have a horizontal width that is greater than a rear region thereof and also gradually increase in size forward. Thus, when the water tank unit 20 is initially mounted, the auxiliary wheel 152 may be more easily guided into the guide groove 260, and thus, the water tank unit 20 may be smoothly mounted.

Figure 4:
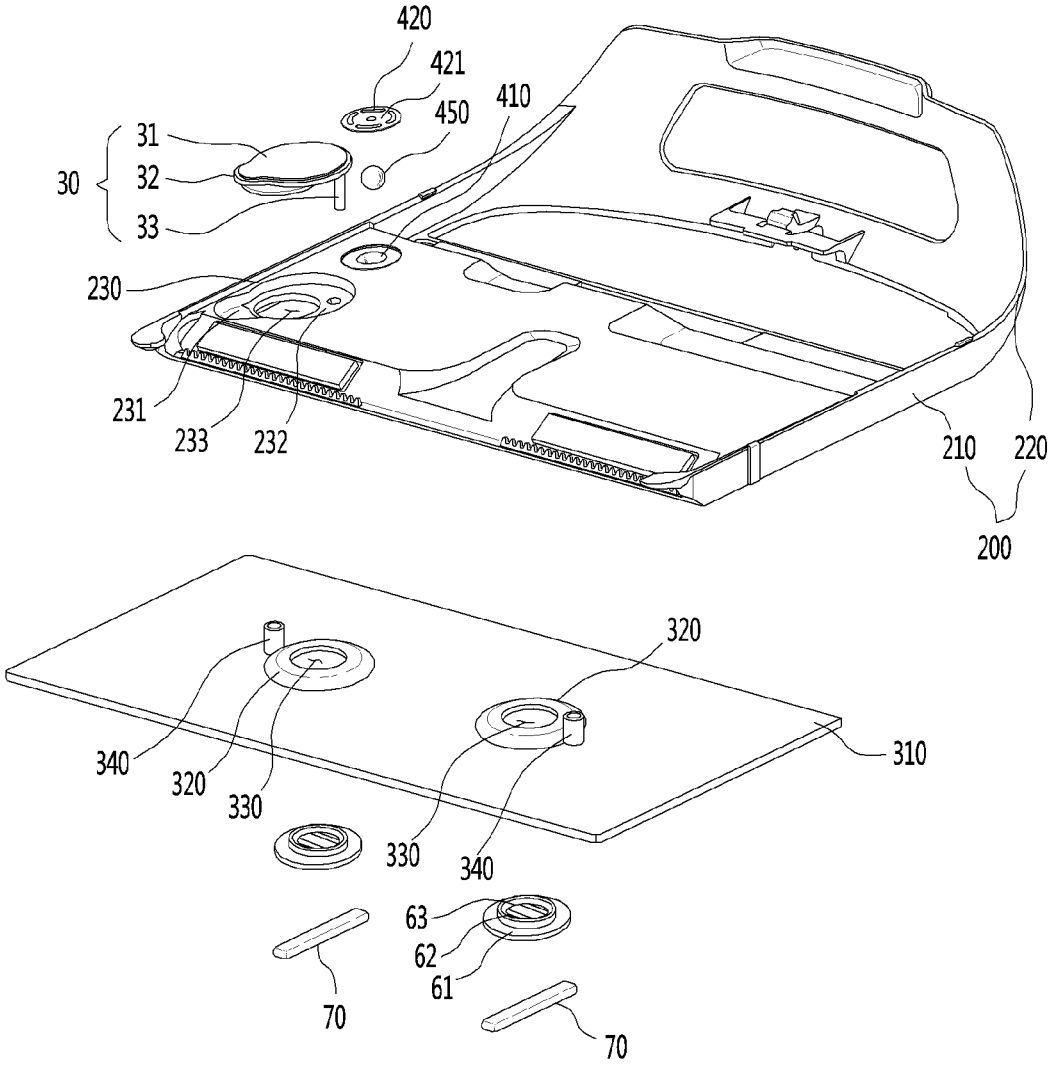
FIG. 4 is an exploded perspective view of the water tank unit according to an embodiment of the present invention.
Figure 5:
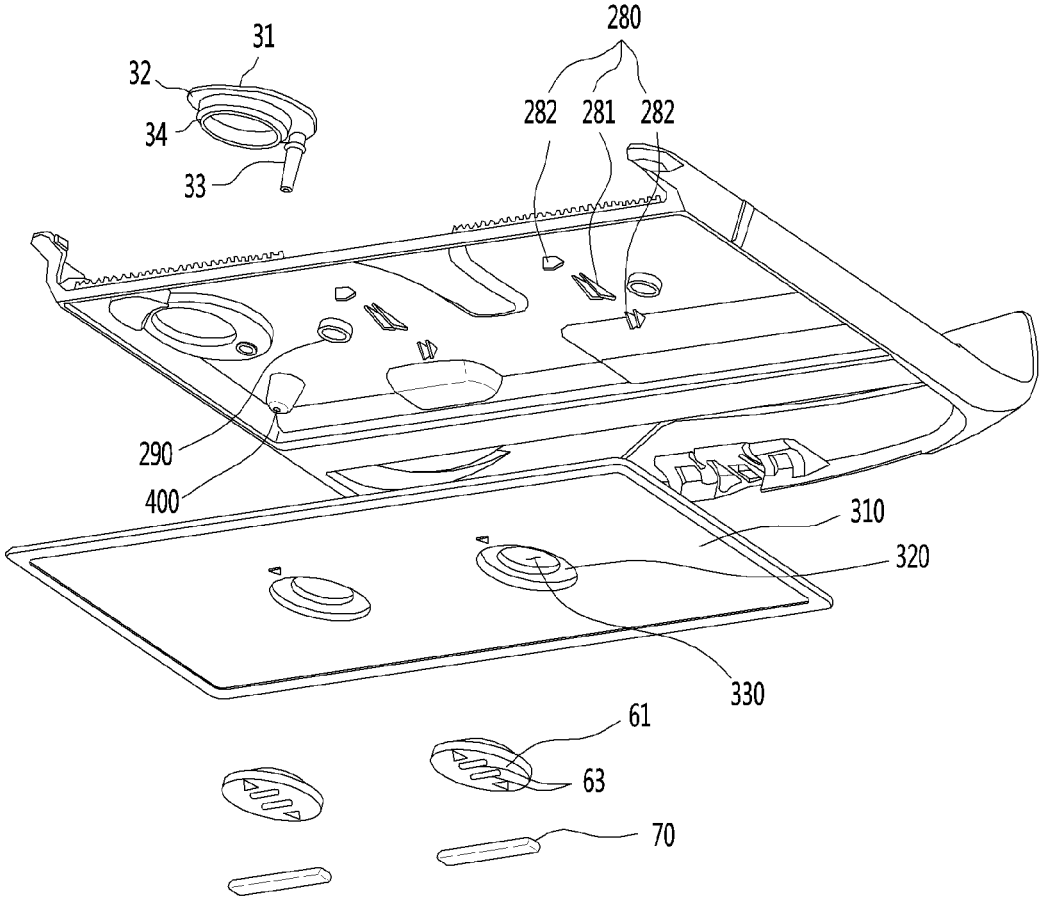
FIG. 5 is an exploded perspective view when

FIG. 4 is an exploded perspective view of the water tank unit according to an embodiment of the present invention, and FIG. 5 is an exploded perspective view when FIG. 4 is viewed from a lower side.

A stopper seating part 232 that is stepped to be recessed from the top surface of the water tank formation part 210 may be formed on the water injection part 230 of the upper member 200. Also, the injection hole 233 may be formed in an approximate center of the stopper seating part 232.

The stopper seating part 232 may be a portion on which the stopper 30 is seated in the state of covering the injection hole 233. The stopper seating part 232 may have a shape corresponding to the stopper 30 and be recessed at a height corresponding to a vertical height of the stopper 30. Also, the injection hole 233 may be provided as a passage for injecting water into the filling space 50 and formed by punching the top surface of the water tank formation part 210.

Also, a stopper grasping groove 231 into which a user's finger is inserted to lift and open one side of the stopper 30 may be formed in the water injection part 230. The stopper grasping groove 231 may extend from one side of the stopper seating part 232 and be further recessed than the stopper seating part 232.

The stopper 30 may include a stopper body 31 seated on the stopper seating part 232, a stopper grasping part 32 protruding from one side of the stopper body 32 toward the stopper grasping groove 231, and a stopper fixing part 33 fixed to one side of the upper member 200.

The stopper grasping part 32 may protrude to cover a portion of an upper portion of the stopper grasping groove 231. Thus, the user's finger may be inserted into the stopper grasping groove 231 to lift the stopper grasping part 32, thereby opening the stopper 30.

The stopper fixing part 33 may protrude downward from one side of the stopper body 31, and a groove or hole into which the stopper fixing part 33 is press-fitted to be fixed may be formed in one side of the stopper seating part 232.

Also, a sealing part 34 protruding in a shape corresponding to the injection hole 233 may be formed on a bottom surface of the stopper body 31. When the stopper 30 covers the injection hole 233, the sealing part 34 may be inserted into the injection hole 233 to contact an inner circumferential surface of the injection hole 233, thereby sealing the injection hole 233.

The air inlet 400 may provide a passage through which air is introduced into the filling space 50. Also, the air inlet 400 may be provided to selectively open the passage through which the air is introduced according to whether the main body 110 operates.

The air inlet 400 may be formed by a recess part 410 recessed from the top surface of the water tank formation part 210 and a recess part stopper 420 covering an opened top surface of the recess part.

The recess part 410 may be recessed to the inside of the filling space 50 to extend toward a bottom surface of the filling space 50. Also, an air hole 416 into which air is introduced into the filling space 50 may be formed in a lower end of the recess part 410.

A circumference of the recess part 410 may be stepped on the top surface of the water tank formation part 210. Also, an end portion of the recess part stopper 420 may be seated on the stepped portion of the circumference of the recess part 410. Here, the stepped portion of the circumference of the recess part 410 may have a depth corresponding to a thickness of the recess part stopper 420 so that a top surface of the recess part stopper 420 and the top surface of the water tank formation part 210 have the same plane.

The recess part stopper 420 may be coupled in various manners in which the recess part stopper is fused to be coupled to the water tank formation part 210 or adheres to the water tank formation part 210 through an adhesive.

A plurality of inflow holes 421 may be formed in the recess part stopper 420 so that air is introduced into the recess part 410. The plurality of inflow holes 421 may be formed to pass through the top surface of the recess part stopper 420 and spaced apart from each other along an edge of the recess part stopper 420. Here, the inflow holes 421 may be formed in an area corresponding to the recess part 410 so that external air is introduced into the recess part 410.

An air inflow control member opening and closing the air holes 416 may be provided in the robot vacuum cleaner 100. The air inflow control member may be provided to selectively open and close the air holes 416 according to whether the main body 110 operates.

The air inflow control member may include a hole switching member 450 provided in the recess part 410 and an electromagnet (see reference numeral 160 of FIG. 8) provided on the main body 110.

Also, the hole switching member 450 may be provided in the recess part 410.

The hole switching member 450 may be accommodated in the recess part 410 and prevented from being separated to the outside of the recess part 410 by the recess part stopper 420.

The hole switching member 450 may vertically move within the recess part 410 according to the driving of the main body 110 to open and close the air holes 416 in the state in which the water tank unit 20 is mounted on the main body 110.

In detail, the hole switching member 450 may be made of a permanent magnet or a metal material. Also, an electromagnet 160 that operates according to the driving of the main body 110 may be provided in the main body 110. Also, the hole switching member 450 may vertically move within the recess part 410 according to the operation of the electromagnet 160.

The air inlet 400 and the air inflow control member will be described in more detail with reference to FIG. 8.

The bottom surface of the lower member 300 may have a flat plate shape.

A covering member mounting part 320 on which the covering member 60 is mounted may be provided in the lower member 300. The number of covering member mounting parts 320 may correspond to the number of covering members 60. In this embodiment, an example in which a pair of covering member mounting parts 320 is provided will be described in detail.

The covering member mounting parts 320 may be provided symmetrical to each other on both left and right sides with respect to a center of the horizontal width and respectively disposed on a pair of lines which are divided into third portions in the horizontal direction.

The covering member mounting part 320 may be disposed so that a bottom surface of the covering member 60 and a bottom surface of the lower member 300 are disposed on the same plane in the state in which the covering member 60 is mounted. In detail, the covering member mounting part 320 may be recessed from the bottom surface of the lower member 300 and protrude from the top surface of the lower member 300. Here, the covering member mounting part 320 may be recessed by a height corresponding the vertical height of the covering member 60 and have a shape corresponding to that of the covering member 60.

Also, a supply hole 330 providing a passage through which water within the filling space 50 moves to the damp cloth may be formed in the recessed inner surface of the covering member mounting part 320. The supply hole 330 may be formed by punching the inner surface of the covering member mounting part 320.

The covering member 60 may include a covering member body 61 having a shape corresponding to the covering member mounting part 320 and an insertion mounting part 62 protruding from the top surface of the covering member body 61 and inserted into the supply hole 330. Also, the covering member 60 may be made of an elastic material such as urethane or rubber.

The covering member body 61 may be inserted into the covering member mounting part 320 to match the covering member mounting part 320. Also, the insertion mounting part 62 may have a shape corresponding to the supply hole 330. The insertion mounting part 62 may be inserted into the supply hole 330 in the state in which the covering member body 61 is inserted into the covering member mounting part 320. Also, the insertion mounting part 62 may be closely attached to the inner surface of the supply hole 330 so that the inner surface of the supply hole 330 and an outer surface of the insertion mounting part 62 are sealed with respect to each other.

Also, a transfer member mounting part 63 on which the water transfer member 70 is mounted may be disposed on one side of the covering member body 61.

The transfer member mounting part 63 may be provided so that the water transfer member 70 passes through the covering member body 61 from the outside of the covering member body 61 and is exposed to the inside of the filling space 50. In detail, the transfer member mounting part 63 may be formed by cutting a portion of the covering member body 61 and pass through the covering member body 61. Here, the transfer member mounting part 63 may be formed in an inner region of the insertion mounting part 62. That is, the insertion mounting part 62 may protrude from an outer area of the transfer member mounting part 63.

Also, the transfer member mounting part 63 may be provided in a pair at positions spaced apart from each other so that both ends of the water transfer member 70 are respectively inserted into the transfer member mounting parts 63. Here, the transfer member mounting part 63 may have a size less than that of a circumference of the water transfer member 70 to prevent water from leaking through a gap between the transfer member mounting part 63 and the water transfer member 70 in the state in which the water transfer member 70 is inserted. Also, since the covering member 60 is made of the elastic material, the cut inner surface of the transfer member mounting part 63 may be provided to elastically press the circumference of the water transfer member 70. Thus, in the state in which the water transfer member 70 is mounted on the transfer member mounting part 63, the water within the filling space 50 may be transferred to the outside through only the water transfer member 70.

The water transfer member 70 may be made of various materials to absorb and transfer water. For example, the water transfer member 70 may be made of a fabric material, more specifically, a nonwoven fabric.

The water transfer member 70 may have a length so that both ends thereof contact the bottom surface of the filling space 50 after both the ends are inserted into the transfer member mounting part 63.

A transfer member guide 280 guiding an end portion of the water transfer member 70 to the bottom surface of the filling space 50 may be disposed on the bottom surface of the water tank formation part 210 of the upper member 200.

The transfer member guide 280 may be disposed at a position corresponding to the transfer member mounting part 63 on the bottom surface of the water tank formation part 210. Also, the transfer member guide 280 may protrude downward from the bottom surface of the water tank formation part 210.

In detail, the transfer member guide 280 may include a first guide 281 guiding both ends of the water transfer member 70 so as to be away from each other in opposite directions and a second guide 282 guiding both the ends of the water transfer member 70 toward the bottom surface of the filling space 50.

The first guide 281 may be disposed vertically above the transfer member mounting part 63. Also, the first guide 281 may have a shape of which a central portion maximally protrudes to inclinedly extend upward from the central portion to the outside. That is, the first guide 281 may protrude in a 'V' shape from the bottom surface of the water tank formation part 210. Thus, both end portions of the water transfer member 70 may be guided along both inclined surfaces of the first guide 281 so as to be away from each other in the opposite direction.

The second guides 282 may be respectively disposed at positions opposite to each other with respect to the first guide 281. Also, the second guide 282 may protrude in a shape that is inclined downward toward the outside with respect to the first guide 281. Thus, both the end portions of the water transfer member 70 may be guided along the inclined surface of the pair of second guides 282 toward the bottom surface of the filling space 50.

The first guide 281 and the pair of second guides 282 may be disposed in front and rear directions on the bottom surface of the water tank formation part 210 to guide both the end portions of the water transfer member 70 downward in the front and rear directions. Here, both the end portions of the water transfer member 70 may be aligned toward the inclined surfaces of the first guide 281 and the second guides 282. For this, a mark for aligning the positions by rotating the covering member 60 may be provided on each of the bottom surfaces of the covering member 60 and the lower member 300.

Alternatively, the transfer member guide 280 may be provided so that the first guide 281 has a cone shape, and the second guide 282 has a ring shape that is formed about the first guide 281. That is, even though the covering member 60 is not aligned through the rotation thereof, the water transfer member 70 may be provided to be guide by the transfer member guide 280.

A support part 340 for improving coupling force when the upper member 200 and the lower member 300 are coupled to each other and preventing the filling space 50 from being deformed may be disposed on the lower member 300. The support part 340 may protrude upward from the top surface of the lower member 300. Also, the support part 340 may be provided in plurality. In this embodiment, a structure in which a pair of support parts is provided will be described in detail.

The support part 340 may be formed at a central portion in a left region and a central portion in a right region when the lower member 3000 is equally divided into left and right portions. Here, the support part 340 may be disposed on an outer end of the covering member mounting part 320.

A support part coupling part 290 into which an upper end of the support part 340 is inserted may be disposed at a position corresponding to the support part 340 on the bottom surface of the water tank formation part 210. A support part insertion part 291 which protrudes from the bottom surface of the water tank formation part 210 and into which the upper end of the support part 340 is inserted may be disposed on the support part coupling part 290. The upper end of the support part 340 may contact an inner top surface of the support part coupling part 290 and be supported by the inner top surface in the state of being inserted into the support part insertion part 291. Thus, the filling space 50 may be prevented from being twisted or deformed by the coupling structure of the support part 340 and the support part coupling part 290. Also, when the upper member 200 and the lower member 300 are coupled to each other, the coupling positions may be aligned with each other.

Alternatively, a structure in which the support part 340 is formed on the upper member 200, and the support part coupling part 290 is formed on the lower member 300 may be possible.

Figure 6:
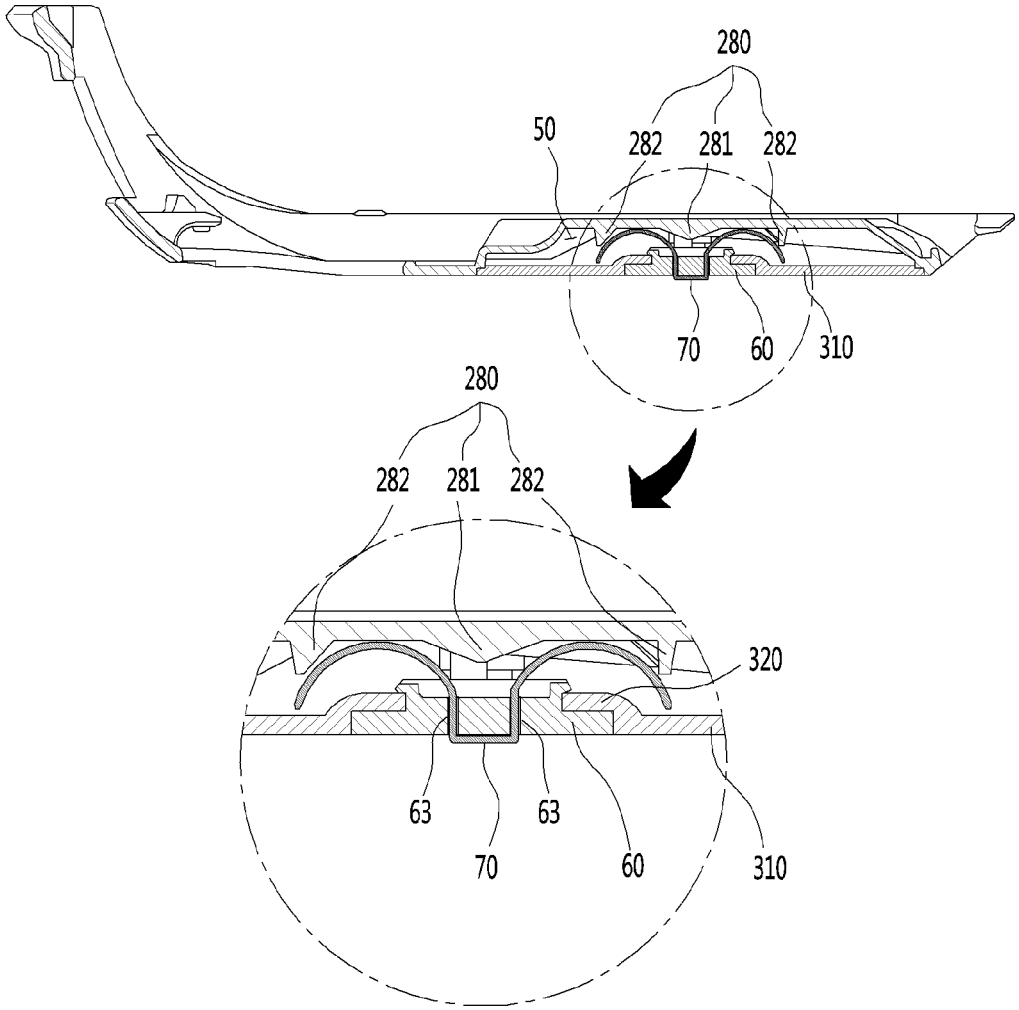
FIG. 6 is a cutaway view illustrating a structure in which the water tank unit is cut along line 6-6' in FIG. 1.

FIG. 6 is a cutaway view illustrating a structure in which the water tank unit is cut along line 6-6' in FIG. 1.

Referring to FIG. 6, the covering member 60 may match the covering member mounting part 320 in the state of being mounted on the covering member mounting part 320. Also, the bottom surface of the covering member 60 may be disposed on the same plane as the bottom surface of the lower member 300.

The water transfer member 70 may be mounted by respectively inserting both ends of the covering member from a lower side into the pair of transfer member mounting parts 63. Also, both the ends of the water transfer member 70 may be guided away from each other in the opposite directions by the first guide 281 inside the filling space 50 and guided downward toward the bottom surface of the filling space 50 by the second guide 282. Here, both the ends of the water transfer member 70 may contact the bottom surface of the filling space 50 to absorb remaining water within the filling space 50.

Also, a portion of the water transfer member 70 may be exposed to the outside of the covering member 60. That is, in the state in which both the ends of the water transfer member 70 are inserted into the transfer member mounting part 63, a portion of the water transfer member 70 may be supported by an area between the pair of transfer member mounting parts 63 spaced apart from each other and be exposed to the bottom surfaces of the transfer member mounting parts 63. Also, the portion exposed to the outside of the water transfer member 70 may contact the damp cloth. Thus, the water transfer member 70 may absorb the water through the portion thereof disposed in the filling space 50 to directly transfer the water to the damp cloth through the portion thereof exposed to the outside.

Here, since the water transfer member 70 directly contacts the damp cloth to transfer the water, an amount of water to be supplied may be adjusted according to a change in water absorption capacity of the damp cloth due to a degree of wetness of the damp cloth. Thus, the stable supply of water to the damp cloth may be realized to prevent the damp cloth from being excessively wet.

Figure 7:
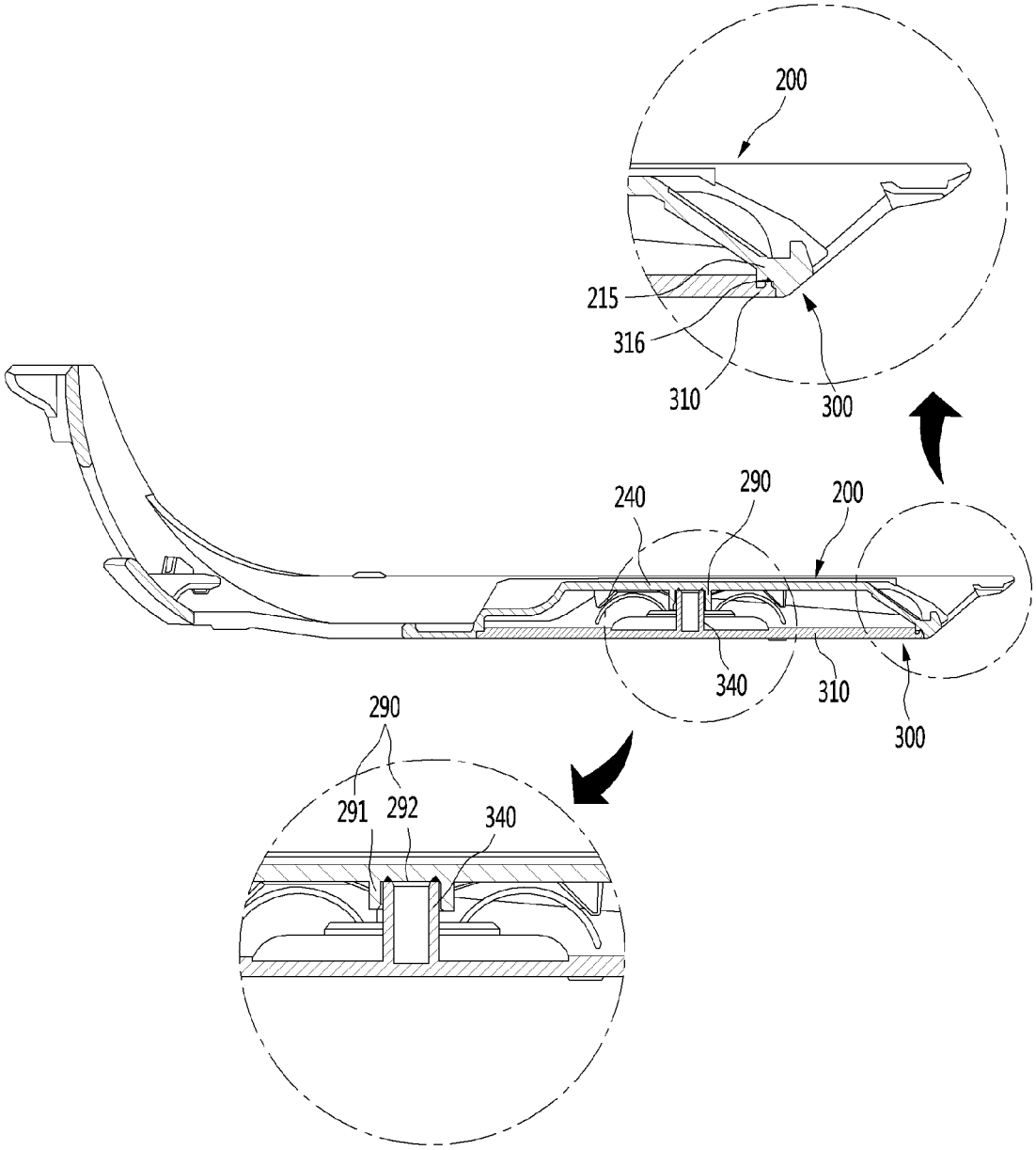
FIG. 7 is a cutaway view illustrating a structure in which the water tank unit is cut along line 7-7' in FIG. 1.

FIG. 7 is a cutaway view illustrating a structure in which the water tank unit is cut along line 7-7' in FIG. 1.

Referring to FIG. 7, a recessed space that is provided as the filling space 50 may be formed in the bottom surface of the water tank formation part 210 of the upper member 200, and the lower member 300 may be coupled to the upper member 200 to cover the recessed space of the bottom surface of the water tank formation part 210.

A lower member joining part 215 on which the end portion of the circumference of the lower member 300 is seated may be formed on the upper member 200. The lower member joining part 215 may be formed along a circumference of the recessed space of the upper member 200 and be stepped so that the end portion of the circumference of the lower member 300 is accommodated. Also, in the state in which the lower member 300 is seated on the lower member joining part 215, the circumferential surface and the edge of the top surface of the lower member 300 may contact an inner surface of the lower member joining part 215.

When the lower member 300 is mounted at the accurate position of the lower member joining part 215, the support part 340 of the lower member 300 may be inserted into the support part coupling part 290 of the upper member 200. That is, the upper end portion of the support part 340 may be inserted into the support part insertion part 291 to contact an inner top surface of the support part insertion part 291. Thus, the support part 340 may support the upper member 200 to prevent the filling space 50 from being deformed and maintain the accurate position in the state in which the lower member 300 is seated on the lower member joining part 215.

The upper member 200 and the lower member 300 may be fused and coupled to each other through one of ultrasonic fusion, vibration fusion, or thermal fusion.

For this, before the lower member 300 and the upper member 200 are coupled to each other, a protrusion for the fusion may be formed on the top surface of the lower member joining part 215 or the circumferential surface of the lower member 300. Also, the protrusion of the fusion may be melted by the ultrasonic fusion or the thermal fusion to couple the lower member 300 to the upper member 200.

The ultrasonic fusion may be a fusion method in which ultrasonic waves are vertically generated to fuse two components with each other through friction therebetween. Also, the vibration fusion is a method in which a component moves to left and right sides to generate friction and fuse the component. Also, the thermal fusion is a method in which a hot plate is placed between an upper jig and a lower jig, and heat is applied to fused surfaces of the respective components to melt the components through the heat.

Figure 8:
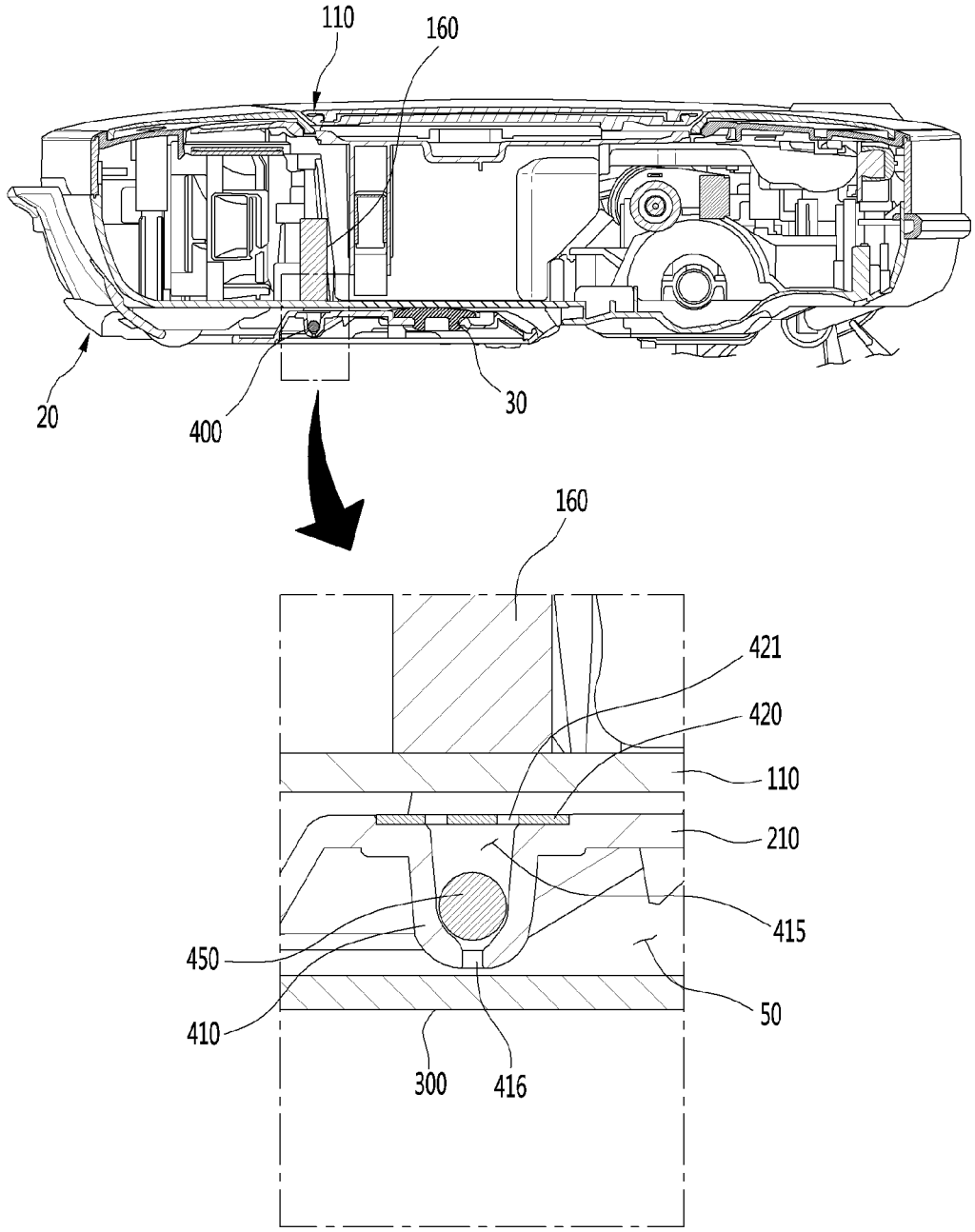
FIG. 8 is a cross-sectional view illustrating a state in which an air hole is covered in a state in which the robot vacuum cleaner is stopped by cutting the robot vacuum cleaner along line 8-8' in FIG. 2.
Figure 9:
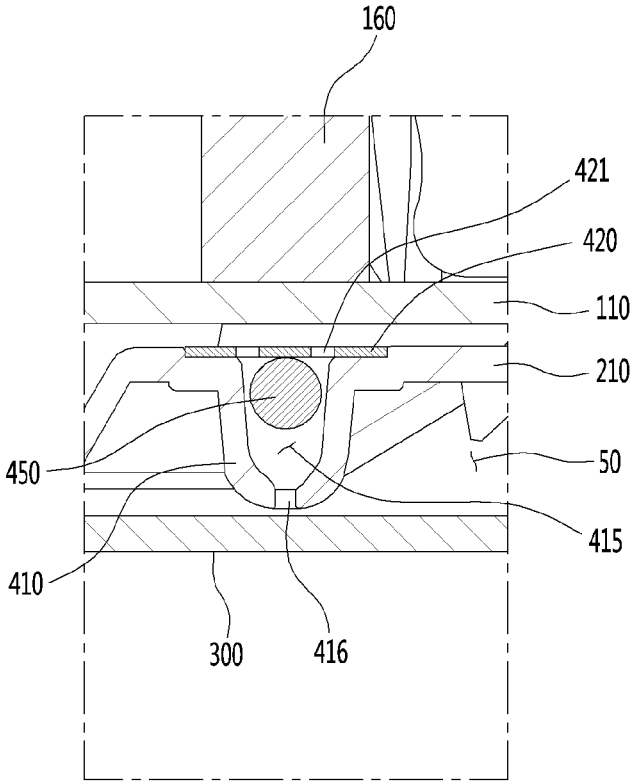
FIG. 9 is a cross-sectional view illustrating a state in which the air hole is opened in a state in which the robot vacuum cleaner is operating in FIG. 8.

FIG. 8 is a cross-sectional view illustrating a state in which the air hole is covered in a state in which the robot vacuum cleaner is stopped by cutting the robot vacuum cleaner along line 8-8' in FIG. 2. FIG. 9 is a cross-sectional view illustrating a state in which the air hole is opened in a state in which the robot vacuum cleaner is operating in FIG. 8.

The recess part 410 may extend up to a position adjacent to the bottom surface of the filling space 50. Here, a lower end of the recess part 410 in which the air hole 416 is formed may be spaced a predetermined distance from the bottom surface of the filling space 50 in a state of being adjacent to the bottom surface.

According to the structure of the recess part 410, if a large amount of water is filled in the filling space 50, the air hole 416 may be blocked by the water. Also, when an air pressure within the filling space 50 is reduced by a predetermined level or more, external air may be introduced through the air hole 416 due to a difference in air pressure. Thus, the air pressure within the filling space 50 may be adjusted to stably control an amount of water supplied to the water transfer member 70, thereby preventing the damp cloth from being excessively wet.

Also, when a small amount of water exists in the filling space 50, the air hole 416 may be opened to continuously supply air into the filling space 50. That is, when the amount of water within the filling space 50 is lower than a lower end of the recess part 410, the air hole 416 may not be blocked by the water. Thus, even though an amount of water is less to reduce a water pressure, the water may be smoothly supplied to the transfer member 70, and also, the remaining water may be effectively used.

The recess part 410 may extend downward from a top surface of the filling space 50, and the extending lower end may be spaced apart from the bottom surface of the filling space 50. Thus, the air hole 416 may be prevented from being blocked by foreign matters introduced into the filling space 50 and scales generated by the water.

The electromagnet 160 may be provided in the main body 110. The electromagnet 160 may be stopped by blocking supply of power in a state in which the main body 110 is stopped. When the main body 110 operates, the electromagnet 160 may operate by supplying the power. Here, the state in which the main body 110 is stopped may be a state in which the main body 110 is completely turned off, a state in which the main body 110 is docked to a charging stand, or a state in which the main body 110 is stopped due to an occurrence of an error.

The electromagnet 160 may be disposed vertically above the air inlet 400 in the state in which the water tank unit 20 is mounted on the main body 110. Thus, the hole switching member 450 may be stably vertically elevated according to the driving of the electromagnet 160.

A space 415 through which the hole switching member 450 moves vertically and which is provided as an air moving passage may be formed in the recess part 410. The space 415 of the recess part 410 may be gradually narrowed downward.

In detail, an upper portion of the space 415 of the recess part 410 may be larger than a circumference of the hole switching member 450. Thus, in the state in which the hole switching member 450 moves upward, a passage through which air is movable may be formed between the inner surface of the recess part 410 and the hole switching member 450.

Also, a lower portion of the space 415 of the recess part 410 may have a size that is enough to contact the circumference of the hole switching member 450. Thus, in the state in which the hole switching member 450 moves downward, a spaced space may not be formed between the inner surface of the recess part 410 and the hole switching member 450, and thus, the air may not flow.

The inflow hole 421 formed in the recess part stopper 420 may be disposed in an inner region of the recess part 410. Thus, external air may be introduced into the recess part 410 through the inflow hole 421.

In this embodiment, the hole switching member 450 may be made of a metal material and have a spherical shape. That is, the hole switching member 450 may be a metal ball.

Alternatively, the hole switching member 450 may be made of various materials that are movable by magnetic force generated in the electromagnet, and various structures that are capable of covering the air hole 416 may be applied.

Hereinafter, operations of the electromagnet 160 and the air inlet 400 will be described in detail with reference to the accompanying drawings.

When the water tank unit 20 is mounted on the main body 110, the mounting of the water tank unit 20 may be detected by the detection device provided in the main body 110. Also, the robot vacuum cleaner 100 may operate in a water cleaning mode using water filled in the water tank unit 20 according to user's setting.

The electromagnet 160 may be controlled so that power is supplied only when the water tank unit 20 is mounted on the main body 110. Also, the electromagnet 160 may be controlled to operate so that the power is supplied only when the wheel 150 operates to allow the main body 110 to move for cleaning.

Referring to FIG. 8, in the state in which the main body 110 is stopped, the electromagnet 160 may not operate. Also, the hole switching member 450 may be disposed at a lower portion of the recess part 410 by a self-weight thereof. Here, an outer circumferential surface of the hole switching member 450 may contact the inner surface of the recess part 410 to cover the passage through which the external air is introduced into the air hole 416. Thus, the air introduced into the space 415 through the inflow hole 421 formed in the recess part stopper 420 may not be introduced into the filling space 50 through the air hole 416.

Also, since the air is not introduced into the filling space 50 through the air hole 416, the air pressure within the filling space 50 may be reduced. Thus, the supply of the water to the damp cloth through the water transfer member 70 may be prevented.

In detail, when the water within the filling space 50 is absorbed to the water transfer member 70 and supplied to the damp cloth, an amount of water within the filling space 50 may be reduced to reduce the air pressure. Here, when the external air is introduced into the filling space 50 through the air inlet 400, the air pressure within the filling space 50 may increase, and the water may be smoothly supplied to the damp cloth through the water transfer member 70.

However, since the introduction of the air through the air inlet 400 is blocked, the external air may not be introduced into the filling space 50 through the air inlet 400. Thus, as the air pressure within the filling space 50 decreases, the absorption of the water into the water transfer member 70 may not be performed to block the water supply to the damp cloth.

That is, when the power is turned off, the main body 110 is mounted on the charging stand to be charged, or an error occurs so that the main body 110 is stopped, the discharge of the water within the filling space 50 may be prevented. Thus, in the state in which the main body 110 is stopped, the water may not be discharged to prevent the bottom from being wet. Also, since the water discharge is blocked to save the water in a situation in which the water inside the filling space 50 is unnecessary, a use time may greatly increase.

Referring to FIG. 9, in the state in which the wheel 150 operates to allow the main body 110 to operate for the cleaning, the electromagnet 160 may operate to generate magnetic force. Also, the hole switching member 450 may move to an upper portion of the recess part 410 by the magnetic force of the electromagnet 160. Here, the outer circumferential surface of the switching member 450 may be spaced apart from the inner surface of the recess part 410 to open the passage through which the external air is introduced into the air hole 416. Thus, the air introduced into the space 415 through the inflow hole 421 formed in the recess part stopper 420 may be introduced into the filling space 50 through the air hole 416.

Also, since the air is introduced into the filling space 50 through the air hole 416, the air pressure within the filling space 50 may increase, and the water may be smoothly supplied to the water transfer member 70.

That is, in the state in which the main body 110 operates for the cleaning, the water of the filling space 50 may be smoothly supplied to the damp cloth through the water transfer member 70. Thus, the smooth water cleaning may be performed.

The structure of the air inlet formed in the water tank unit and the structure of the air inflow control member may not limited to the foregoing embodiment, and various structures in which the air hole is openable by the magnetic force of the electromagnet provided in the main body may be applied.

Figure 10:
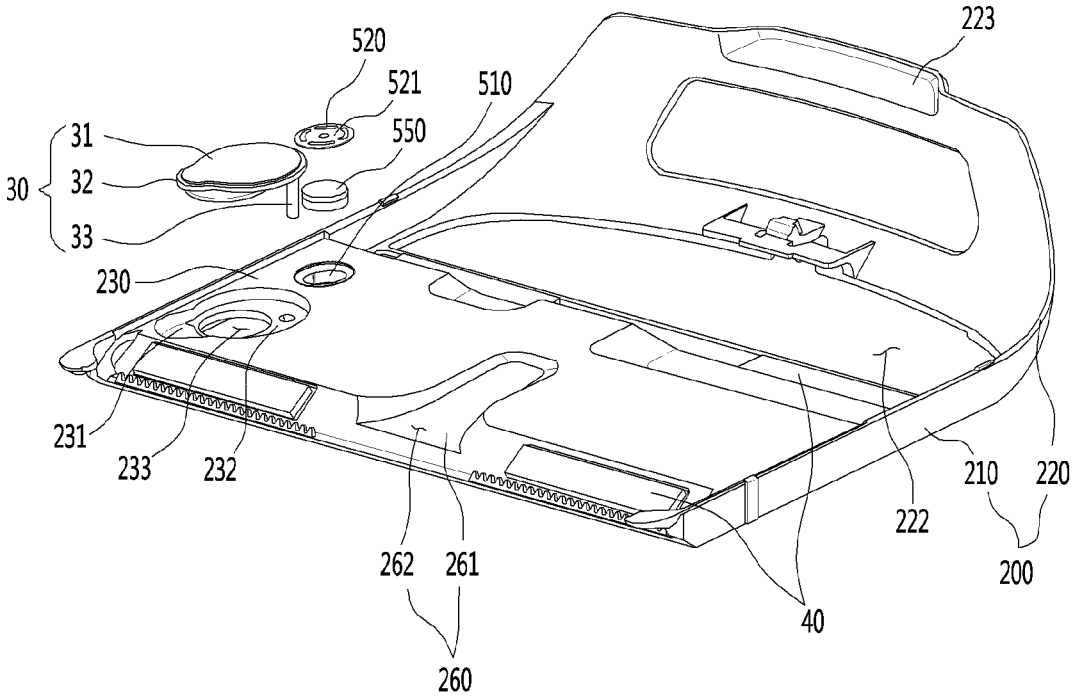
FIG. 10 is a perspective view illustrating a water tank unit according to another embodiment of the present invention.
Figure 11:
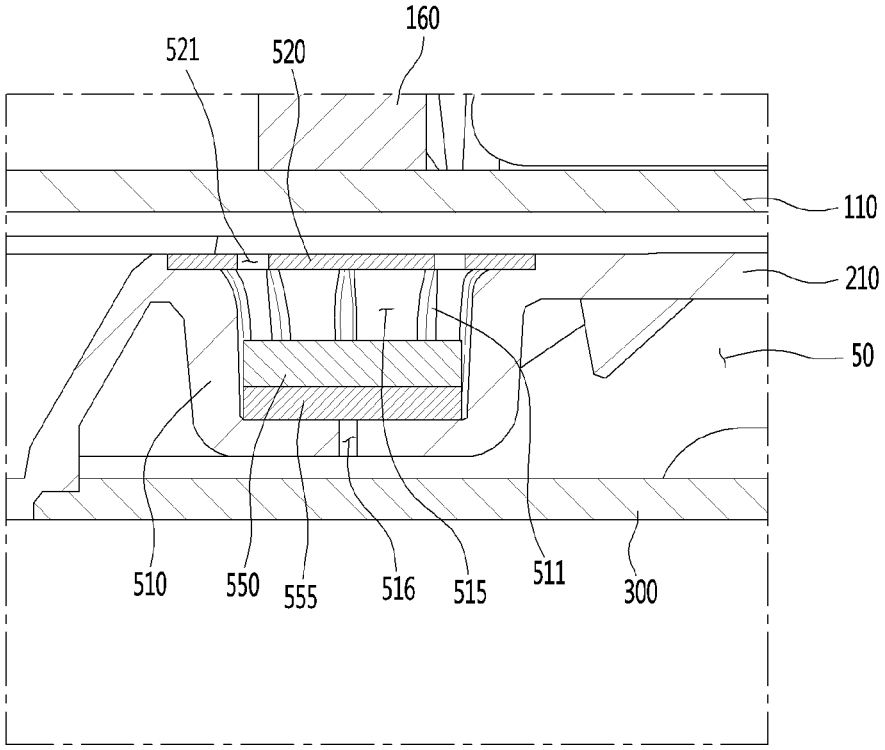
FIG. 11 is a cross-sectional view illustrating a state in which an air hole is covered in a state in which a robot vacuum cleaner is stopped according to another embodiment of the present invention.
Figure 12:
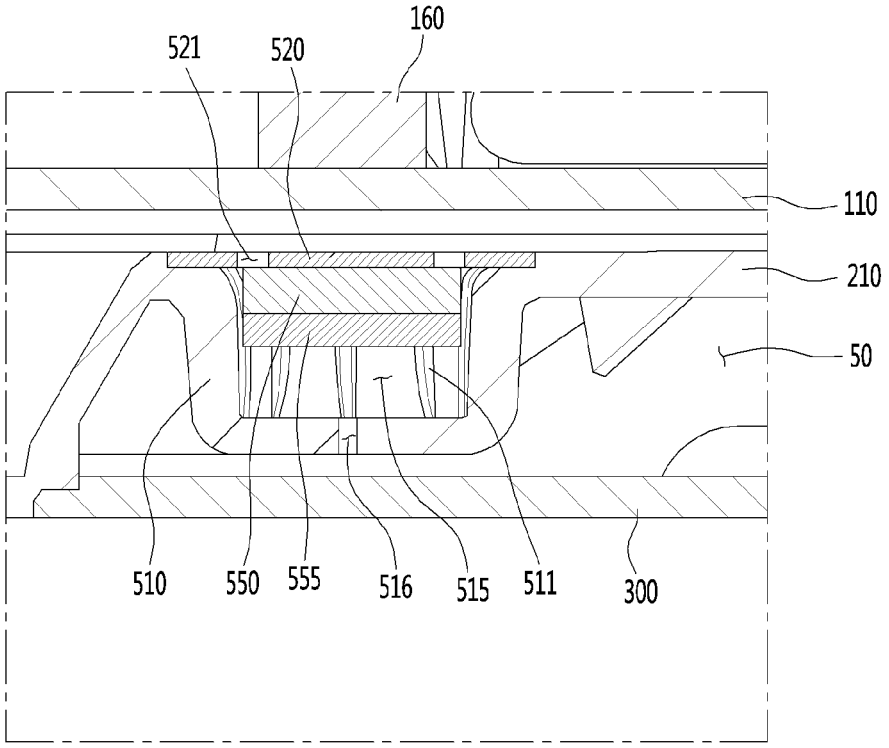
FIG. 12 is a cross-sectional view illustrating a state in which the air hole is opened in a state in which the robot vacuum cleaner is operating according to another embodiment of the present invention.

FIG. 10 is a perspective view illustrating a water tank unit according to another embodiment of the present invention. FIG. 11 is a cross-sectional view illustrating a state in which an air hole is covered in a state in which a robot vacuum cleaner is stopped according to another embodiment of the present invention. FIG. 12 is a cross-sectional view illustrating a state in which the air hole is opened in a state in which the robot vacuum cleaner is operating according to another embodiment of the present invention.

Hereinafter, an air inlet according to another embodiment will be described in detail. Also, since the above-described constituents are the same except for the structure of the air inlet and the air inflow control member, the other constituents except for the air inlet and the air inflow control member use the same reference numerals and names and omit their detailed descriptions.

An air inlet 500 for adjusting an air pressure within a filling space 50 may be formed in a water tank formation part 210 of a water tank unit 20.

The air inlet 500 may be formed in an end portion in which a water injection hole 233 is formed.

The air inlet 500 may provide a passage through which air is introduced into a filling space 50.

The air inlet 500 may be formed by a recess part 510 recessed from a top surface of the water tank formation part 210 and a recess part stopper 520 covering an opened top surface of a recess part.

The recess part 510 may be recessed to the inside of the filling space 50 to extend toward a bottom surface of the filling space 50. Also, an air hole 516 into which air is introduced into the filling space 50 may be formed in a lower end of the recess part 510. Here, a lower end of the recess part 510 in which an air hole 516 is formed may be spaced a predetermined distance from the bottom surface of the filling space 50 in a state of being adjacent to the bottom surface.

A circumference of the recess part 510 may be stepped on a top surface of the water tank formation part 210. Also, an end portion of a recess part stopper 520 may be seated on the stepped portion of a circumference of the recess part 510.

The recess part stopper 520 may be coupled in various manners in which the recess part stopper is fused to be coupled to the water tank formation part 210 or adheres to the water tank formation part 210 through an adhesive.

A plurality of inflow holes 521 may be formed in the recess part stopper 520 so that air is introduced into the recess part 510. The plurality of inflow holes 521 may be formed to pass through the top surface of the recess part stopper 520 and spaced apart from each other along an edge of the recess part stopper 520. Here, the inflow holes 521 may be formed in an area corresponding to the recess part 510 so that external air is introduced into the recess part 510.

An air inflow control member opening and closing the air holes 516 may be provided in the robot vacuum cleaner 100. The air inflow control member may be provided to selectively open and close the air holes 516 according to whether a main body 110 operates.

The air inflow control member may include a hole switching member 550 provided in the recess part 510 and an electromagnet 160 provided on the main body 110.

The hole switching member 550 may be accommodated in the recess part 510 and prevented from being separated to the outside of the recess part 510 by the recess part stopper 520.

The hole switching member 550 may vertically move within the recess part 510 according to the driving of the main body 110 to open and close the air holes 516 in the state in which the water tank unit 20 is mounted on the main body 110.

The hole switching member 550 may be made of a permanent magnet or a metal material. Also, the electromagnet 160 that operates according to the driving of the main body 110 may be provided in the main body 110. Also, the hole switching member 550 may vertically move within the recess part 510 according to the operation of the electromagnet 160.

The electromagnet 160 may be disposed vertically above the air inlet 500 in the state in which the water tank unit 20 is mounted on the main body 110. Thus, the hole switching member 550 may be stably vertically elevated according to the driving of the electromagnet 160.

In more detail, the hole switching member 440 may have a disk shape having a predetermined thickness. Also, a sealing member 555 may be provided on a bottom surface of the hole switching member 550. When the hole switching member 550 moves to a lower portion of the recess part 510, the sealing member 555 may contact a bottom surface of the recess part 510 to stably block a flow of air through the air hole 516. For this, the sealing member may be made of a material having predetermined elastic force to reduce noise and an impact, for example, made of rubber.

A space 515 through which the hole switching member 550 moves vertically and which is provided as an air moving passage may be formed in the recess part 510. The space 515 of the recess part 510 may have a shape corresponding to that of the hole switching member 550. Also, the space 515 may be formed further lengthily than the hole switching member 550 so that the hole switching member 550 vertically moves.

An inner surface of the recess part 510 may be spaced apart from a circumference of the hole switching member 550 so that the air flows through the space 515 of the recess part 510. That is, a circumference of an inner surface of the recess part 510 may be larger than the circumference of the hole switching member 550.

Also, a plurality of ribs 511 are formed to lengthily protrude in a vertical direction on the inner surface of the recess part 510. The plurality of ribs 511 may be spaced apart from each other along the circumference of the inner surface of the recess part 510. The ribs 511 may contact a circumferential surface of the hole switching member 550 to guide vertical movement of the hole switching member 550 and prevent the hole switching member 550 from laterally moving. Also, air may flow through a space between the plurality of ribs 511.

The inflow hole 521 may be disposed to correspond the space between the plurality of ribs 511. Thus, when the hole switching member 550 moves upward to contact the recess part stopper 520, the inflow hole 521 may not be covered, but the air may be introduced.

Hereinafter, operations of the electromagnet 160 and the air inlet 500 will be described in detail with reference to the accompanying drawings.

Referring to FIG. 11, in the state in which the main body 110 is stopped, the electromagnet 160 may not operate. Also, the hole switching member 550 may be disposed at a lower portion of the recess part 510 by a self-weight thereof. Here, the sealing member 555 provided on the bottom surface of the hole switching member 550 may contact the bottom surface of the recess part 510 to cover the air hole 516. Thus, the air introduced into the space 515 through the inflow hole 521 formed in the recess part stopper 520 may not be introduced into the filling space 50 through the air hole 516.

Thus, since the air is not introduced into the filling space 50 through the air hole 516, the air pressure within the filling space 50 may be adjusted to prevent the water from being supplied to the damp cloth through the water transfer member 70.

Referring to FIG. 12, when the main body 110 moves to perform cleaning, the electromagnet 160 may operate to generate magnetic force. Also, the hole switching member 550 may move to an upper portion of the recess part 510 by the magnetic force of the electromagnet 160. Thus, the air introduced into the space 515 through the inflow hole 521 formed in the recess part stopper 520 may be introduced into the filling space 50 through the air hole 516.

Also, since the air is introduced into the filling space 50 through the air hole 516, the air pressure within the filling space 50 may increase, and the water may be smoothly supplied to the water transfer member 70.

The present invention is not limited to the structure in which the electromagnet is provided in the main body 110. That is, the air inlet and the air inflow control member according to the present invention may be applied in various structures in which the air hole formed in the water tank unit is selectively openable according to the driving of the main body 110.

Hereinafter, an embodiment in which the air inlet and the air inflow control member are configured to selectively open the air hole according to whether the main body 110 operates in the structure in which the electromagnet is provided in the main body 110 will be described.

Figure 13:
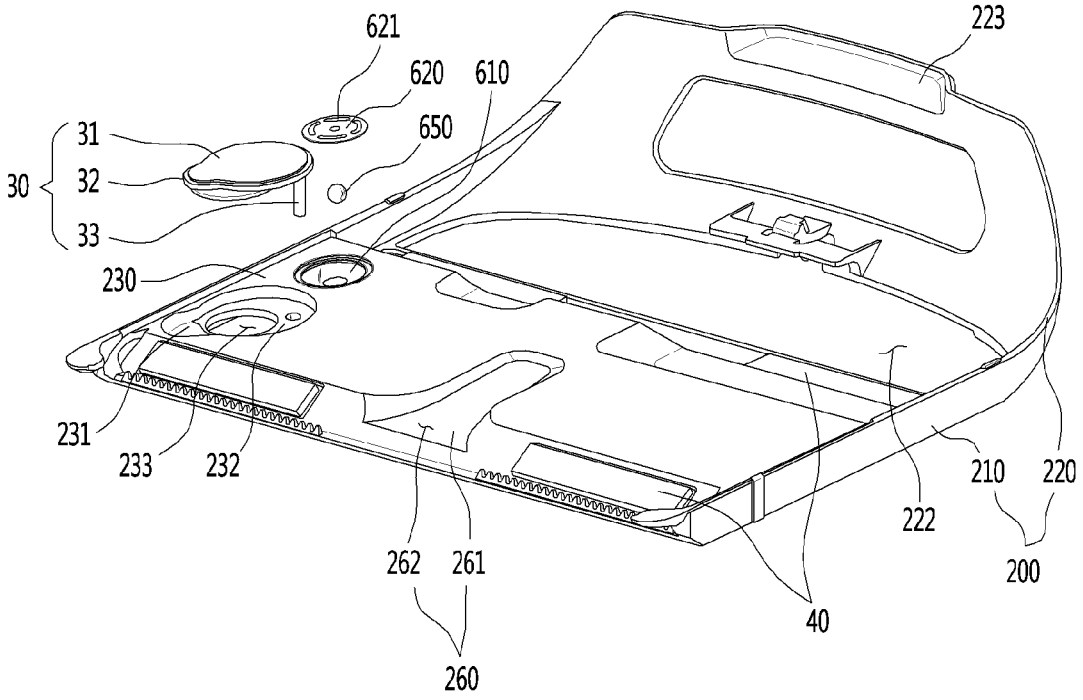
FIG. 13 is a perspective view illustrating a water tank unit according to further another embodiment of the present invention.
Figure 14:
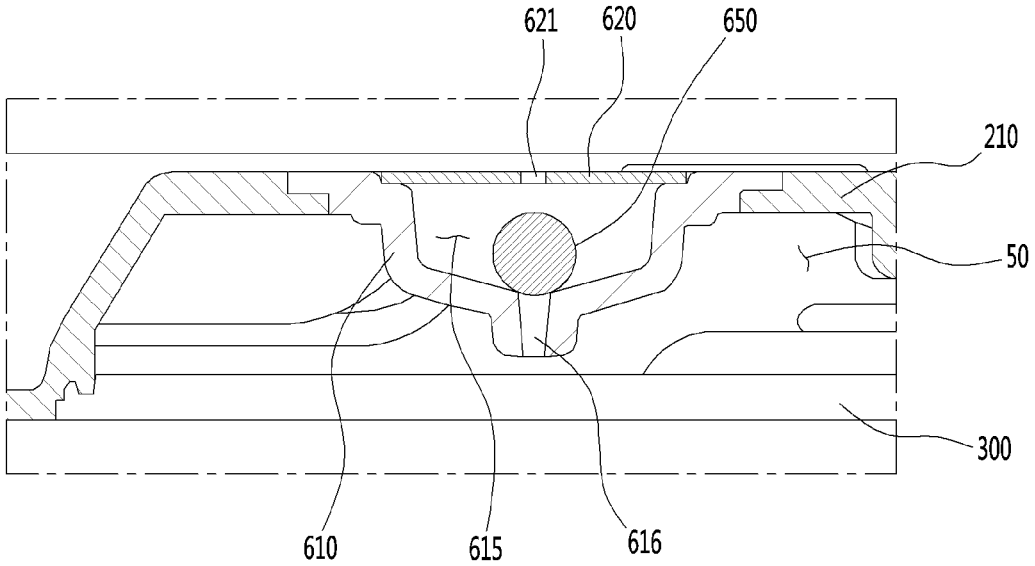
FIG. 14 is a cross-sectional view illustrating a state in which an air hole is covered in a state in which a robot vacuum cleaner is stopped according to further another embodiment of the present invention.
Figure 15:
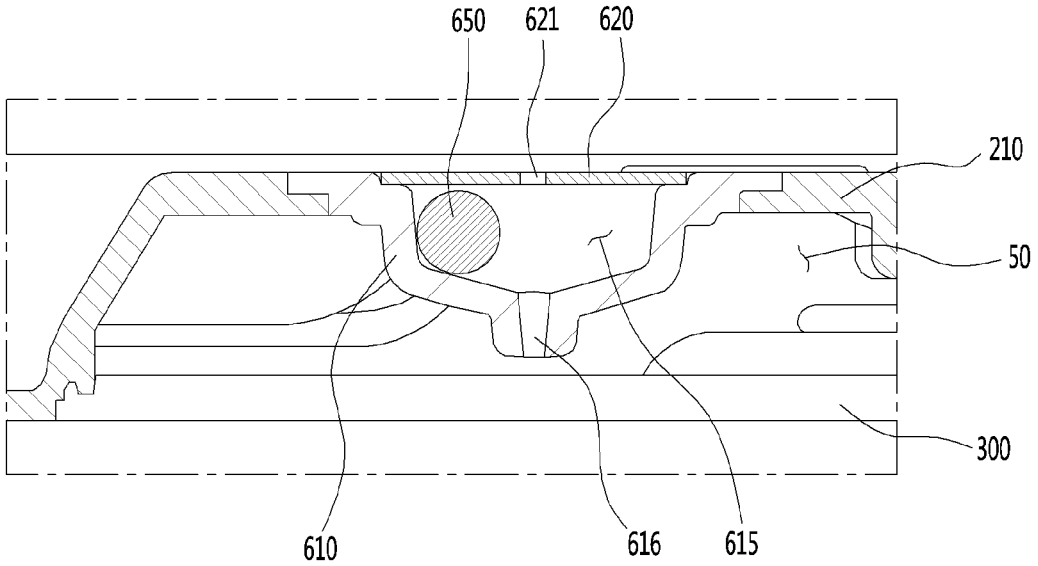
FIG. 15 is a cross-sectional view illustrating a state in which the air hole is opened in a state in which the robot vacuum cleaner is operating according to further another embodiment of the present invention.

FIG. 13 is a perspective view illustrating a water tank unit according to further another embodiment of the present invention. FIG. 14 is a cross-sectional view illustrating a state in which an air hole is covered in a state in which a robot vacuum cleaner is stopped according to further another embodiment of the present invention. FIG. 15 is a cross-sectional view illustrating a state in which the air hole is opened in a state in which the robot vacuum cleaner is operating according to further another embodiment of the present invention.

Also, hereinafter, since the above-described constituents and characteristics are the same except for the air inlet and the air inflow control member, the other constituents except for the air inlet and the air inflow control member use the same reference numerals and names and omit their detailed descriptions.

An air inlet 600 for adjusting an air pressure within a filling space 50 may be formed in a water tank formation part 210 of a water tank unit 20.

The air inlet 600 may be formed in an end portion in which a water injection hole 233 is formed.

The air inlet 600 may provide a passage through which air is introduced into a filling space 50.

The air inlet 600 may be formed by a recess part 610 recessed from a top surface of the water tank formation part 210 and a recess part stopper 620 covering an opened top surface of a recess part. Also, the hole switching member 650 may be provided in the recess part 610.

The recess part 610 may be recessed to the inside of the filling space 50 to extend toward a bottom surface of the filling space 50. Also, an air hole 616 into which air is introduced into the filling space 50 may be formed in a lower end of the recess part 610. Here, a lower end of the recess part 610 in which an air hole 616 is formed may be spaced a predetermined distance from the bottom surface of the filling space 50 in a state of being adjacent to the bottom surface.

A circumference of the recess part 610 may be stepped on a top surface of the water tank formation part 210. Also, an end portion of a recess part stopper 620 may be seated on the stepped portion of a circumference of the recess part 610.

The recess part stopper 620 may be coupled in various manners in which the recess part stopper is fused to be coupled to the water tank formation part 610 or adheres to the water tank formation part 210 through an adhesive.

An inflow hole 621 may be formed in the recess part stopper 620 so that air is introduced into the recess part 610. The inflow hole 621 may be formed to pass through a top surface of the recess part stopper 620 and formed at a center of the recess part stopper 620. The inflow hole 421 may be provided in plurality to pass through the top surface of the recess part stopper 620 and spaced apart from each other along an edge of the recess part stopper 620. Here, the inflow holes 621 may be formed in an area corresponding to the recess part 610 so that external air is introduced into the recess part 610.

An air inflow control member opening and closing the air holes 616 may be provided in the robot vacuum cleaner 100. The air inflow control member may be provided to selectively open and close the air holes 616 according to whether a main body 110 operates.

The air inflow control member may include a hole switching member 550 provided in the recess part 610.

The hole switching member 650 may be accommodated in the recess part 610 and prevented from being separated to the outside of the recess part 610 by the recess part stopper 620.

The hole switching member 650 may flow within the recess part 610 according to the driving of the main body 110 to open and close the air holes 616 in the state in which the water tank unit 20 is mounted on the main body 110.

In detail, the hole switching member 650 may have a spherical shape.

Also, a space 512 which is provided as an moving passage and in which the hole switching member 650 is movably accommodated may be formed in the recess part 610. The space 615 may have a width greater than a diameter of the hole switching member 650. For example, the space 615 may have a cross-sectional diameter greater than a diameter of the hole switching member 650. That is, the inner surface of the recess part 610 may be spaced apart from the hole switching member 650.

Also, a bottom surface of the space 615 may be gradually inclined downward from the outside to a center. Also, the air hole 616 may be formed in the center of the bottom surface of the space 615. That is, the air hole 616 may pass through the center of the bottom surface of the space 615 to communicate with the filling space 50.

According to this structure, in the state in which the main body 110 is stopped, the hole switching member 65 may be disposed at the center of the bottom surface of the space 615 by the inclination of the bottom surface of the space 615. Also, the hole switching member 650 may be disposed above the air hole 616 to cover the air hole 616.

That is, as illustrated in FIG. 14, in the state in which the main body 110 is stopped, the air hole 616 may be covered by the hole switching member 650. Thus, the air introduced into the space 615 through the inflow hole 621 formed in the recess part stopper 620 may not be introduced into the filling space 50 through the air hole 616.

Thus, since the air is not introduced into the filling space 50 through the air hole 616, the air pressure within the filling space 50 may be adjusted to prevent the water from being supplied to the damp cloth through the water transfer member 70.

Referring to FIG. 15, when the main body 110 is accelerated or changed in moving direction to perform the cleaning, the hole switching member 650 may move from the center of the bottom surface of the space 615 to the outside by inertia. Also, the air hole 616 may be opened. Thus, the air introduced into the space 616 through the inflow hole 621 formed in the recess part stopper 620 may be introduced into the filling space 50 through the air hole 616.

Thus, since the air is introduced into the filling space 50 through the air hole 616, the air pressure within the filling space 50 may increase, and the water may be smoothly supplied to the water transfer member 70.

Hereinafter, further another embodiment in which the air inlet and the air inflow control member are configured to selectively open the air hole according to whether the main body 110 operates in the structure in which the electromagnet is provided in the main body 110 will be described in detail.

Figure 16:
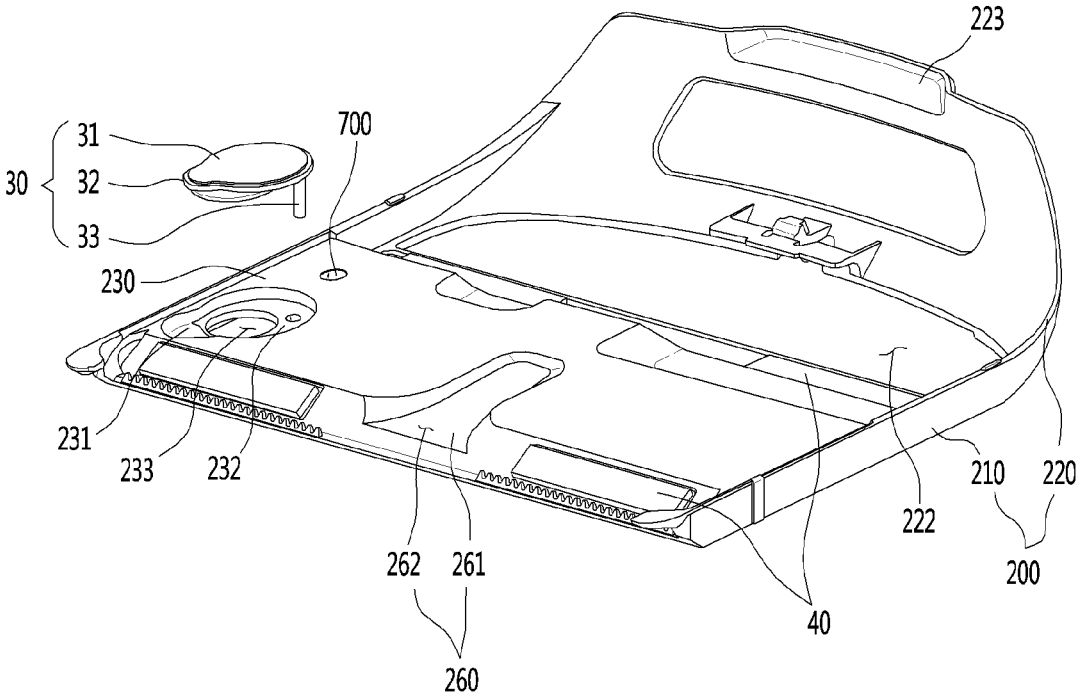
FIG. 16 is a perspective view illustrating a water tank unit according to further another embodiment of the present invention.
Figure 17:
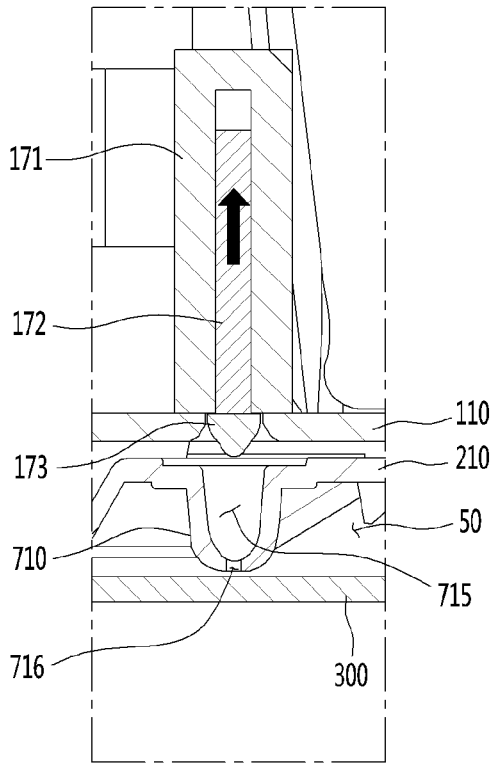
FIG. 17 is a cross-sectional view illustrating a state in which an air hole is covered in a state in which a robot vacuum cleaner is stopped according to the embodiment of FIG. 16.
Figure 18:
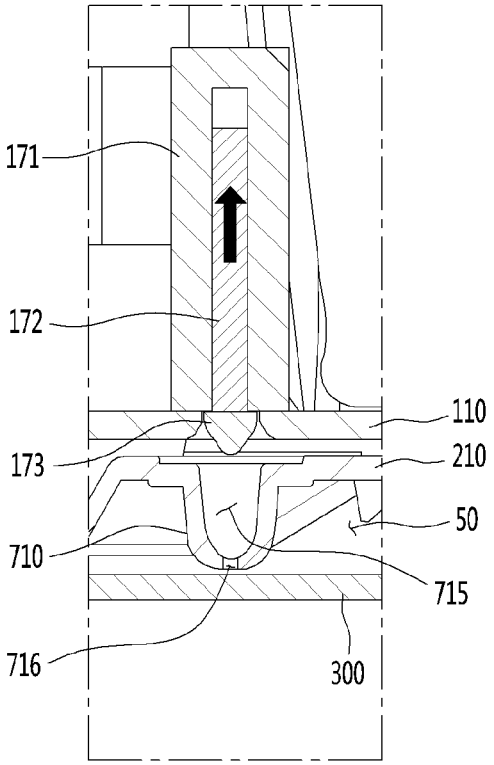
FIG. 18 is a cross-sectional view illustrating a state in which the air hole is opened in a state in which the robot vacuum cleaner is operating according to the embodiment of FIG. 16.

FIG. 16 is a perspective view illustrating a water tank unit according to further another embodiment of the present invention. FIG. 17 is a cross-sectional view illustrating a state in which an air hole is covered in a state in which a robot vacuum cleaner is stopped according to the embodiment of FIG. 16. FIG. 18 is a cross-sectional view illustrating a state in which the air hole is opened in a state in which the robot vacuum cleaner is operating according to the embodiment of FIG. 16.

Also, hereinafter, since the above-described constituents and characteristics are the same except for the air inlet and the air inflow control member, the other constituents except for the air inlet and the air inflow control member use the same reference numerals and names and omit their detailed descriptions.

Referring to FIG. 16, an air inlet 700 for adjusting an air pressure within a filling space 50 may be formed in a water tank formation part 210 of a water tank unit 20.

The air inlet 700 may be formed in an end portion in which a water injection hole 233 is formed.

The air inlet 700 may provide a passage through which air is introduced into a filling space 50. Also, the air inlet 700 may be provided to selectively open the passage through which the air is introduced according to whether a main body 110 operates.

The air inlet 700 may be formed by a recess part 710 in a top surface of the water tank formation part 210.

The recess part 710 may be recessed to the inside of the filling space 50 to extend toward a bottom surface of the filling space 50. Also, an air hole 716 into which air is introduced into the filling space 50 may be formed in a lower end of the recess part 710. Here, a lower end of the recess part 710 in which an air hole 716 is formed may be spaced a predetermined distance from the bottom surface of the filling space 50 in a state of being adjacent to the bottom surface.

An air inflow control member opening and closing the air holes 716 may be provided in the robot vacuum cleaner 100. The air inflow control member may be provided to selectively open and close the air holes 716 according to whether a main body 110 operates.

The air inflow control member may be a solenoid valve 170 provided in the main body 110. The solenoid valve 170 may operate according to the operation of the main body 110.

The solenoid valve 170 may include a valve body 171 generating magnetic fields by power supplied from the main body 110 and a shaft 172 that is accessible into the valve body 171. Also, a gasket 173 may be disposed on an end portion of the shaft 172.

When the power is supplied to the shaft 172, the shaft 172 may be withdrawn from the valve body 171 by the magnetic fields. Also, the shaft 172 may operate to be inserted into the recess part 710.

Also, when the supply of the power to the valve body 171 is blocked, the shaft 172 may be inserted into the valve body 171 so as to be withdrawn from the inside of the recess part 710.

For this, the solenoid valve 170 may be disposed vertically above the air inlet 700 in the state in which the water tank unit 20 is mounted on the main body 110. That is, the shaft 172 may be disposed vertically above the air inlet 700.

Also, the shaft 172 may be lengthily formed in a vertical direction to vertically operate.

Also, a hole through which the shaft 172 passes may be formed in a position corresponding to the air inlet 700 in the bottom surface of the main body 110. An end portion of the shaft 172 may be exposed through the hole formed in the bottom surface of the main body 110 in the state in which the shaft 172 is inserted into the valve body 171. Here, the end portion of the shaft 172 may be in a state of being completely inserted into the main body 110.

The solenoid valve 170 may be controlled so that power is supplied only when the water tank unit 20 is mounted on the main body 110. Also, the solenoid valve 170 may be controlled so that the power is supplied only when the main body 110 is stopped.

Referring to FIG. 17, in the state in which the main body 110 is stopped, the solenoid valve 170 may be in an operating state. That is, the shaft 172 may be in a state of being inserted into the recess part 710. Also, the gasket 173 provided on the end portion of the shaft 172 may contact the bottom surface of the recess part 710 to cover the air hole 716.

Thus, since the air is not introduced into the filling space 50 through the air hole 716, the air pressure within the filling space 50 may be adjusted to prevent the water from being supplied to the damp cloth through the water transfer member 70.

The gasket 173 may have a shape corresponding to that of the recess part 710 so as to be closely attached to the inner circumferential surface and bottom surface of the recess part 710. Thus, in the state in which the shaft 172 is inserted into the recess part 710, the gasket 173 may be closely attached to the inner surface of the recess part 710 to effectively prevent the air from flowing through the air hole 716.

Also, the gasket 173 may be made of a material having predetermined elasticity to reduce an impact and noise, for example, made of rubber.

Referring to FIG. 18, in the state in which the main body 110 operate to perform cleaning, the solenoid valve 170 may not operate. That is, the power supplied to the solenoid valve 170 may be blocked, and the shaft 172 may be withdrawn from the recess part 710 to open the opened top surface of the recess part 710. Thus, the external air may be introduced into the recess part 710 through the opened top surface of the recess part 710, and the air may be introduced into the filling space 50 through the air hole 716.

Therefore, since the air is introduced into the filling space 50 through the air hole 716, the air pressure within the filling space 50 may increase, and the water may be smoothly supplied to the water transfer member 70.

INDUSTRIAL APPLICABILITY

In the robot vacuum cleaner according to the embodiment of the present invention, when the robot vacuum cleaner perform the water cleaning, the water may be smoothly supplied to the damp cloth, and when the water cleaning is stopped, the water may be effectively prevented from being unnecessarily consumed.

Thus, the water cleaning time may increase, the problem of wetting the floor due to the supply of the unnecessary water may be prevented, and the satisfaction of the user may be greatly improved, so that the industrial applicability will be high.

The invention claimed is:

1. A robot vacuum cleaner comprising:

a main body running along a surface to be cleaned, the main body being configured to suction and filter dusts on the surface to be cleaned and then discharge air;

a water tank unit which is detachably mounted on a bottom surface of the main body and on which a damp cloth is mounted;

a filling space formed in the water tank unit, the filling space being configured to store water to be supplied to the damp cloth;

a water supply unit mounted on a bottom surface of the water tank unit, the water supply unit being configured to supply the water within the filling space to the damp cloth;

an air inlet which is formed in a top surface of the water tank unit and in which an air hole through which external air is introduced into the filling space is formed; and an air inflow control member configured to open the air hole when the main body runs and cover the air hole when the main body is stopped.

2. The robot vacuum cleaner according to claim 1, wherein the air inlet comprises a recess part that is recessed from a top surface of the water tank unit into the filling space, and the air hole is formed in a lower end of the recess part.

3. The robot vacuum cleaner according to claim 2, wherein the recess part extends up to a position adjacent to a bottom surface of the filling space.

4. The robot vacuum cleaner according to claim 2, wherein the air inlet further comprises a recess part stopper configured to cover an opened top surface of the recess part, and an inflow hole through which the external air is introduced into the recess part is formed in the recess part stopper.

5. The robot vacuum cleaner according to claim 4, wherein the air inflow control member comprises:

an electromagnet provided in the main body to generate magnetic force by supplying power when the main body runs; and a hole switching member configured to open and close the air hole by vertical movement of the recess part, the hole switching member moving upward when the magnetic force of the electromagnet is generated to open the air hole.

6. The robot vacuum cleaner according to claim 5, wherein a detection device configured to detect mounting of the water tank unit is provided in the main body, and when the main body operates in the state in which the water tank unit is mounted on the main body, the power is supplied to the electromagnet.

7. The robot vacuum cleaner according to claim 5, wherein the hole switching member has a height less than a depth of the recess part.

8. The robot vacuum cleaner according to claim 5, wherein the recess part has a diameter that gradually decreases downward from an upper side, and the hole switching member has a spherical shape and is formed with a diameter corresponding to a lower diameter of the recess part.

9. The robot vacuum cleaner according to claim 5, wherein the hole switching member has a plate shape, a plurality of ribs configured to guide the vertical movement of the hole switching member protrude from an inner surface of the recess part, and the plurality of ribs are spaced apart from each other along a circumference of the inner surface of the recess part to extend in a vertical direction.

10. The robot vacuum cleaner according to claim 9, wherein at least a portion of the inflow hole is disposed further outward than the hole switching member.

11. The robot vacuum cleaner according to claim 9, wherein the inflow hole is formed at a position corresponding to a space between the ribs adjacent to each other.

12. The robot vacuum cleaner according to claim 9, wherein a sealing member is disposed on a bottom surface of the hole switching member, and the sealing member has a shape corresponding to a bottom surface of the recess part.

13. The robot vacuum cleaner according to claim 2, wherein the air inflow control member comprises a hole switching member provided in the recess part, having a diameter less than that of the recess part, and having a spherical shape, wherein the air inflow control member is disposed on a top surface of the air hole to cover the air hole in a state in which the main body is stopped and moves to a side of the air hole to open the air hole by inertia caused by acceleration force of the main body when the main body runs.

14. The robot vacuum cleaner according to claim 13, wherein the bottom surface of the recess part is inclined downward toward a center thereof, and the air hole is formed in the center of the bottom surface of the recess part.

15. The robot vacuum cleaner according to claim 2, wherein the air inflow control member comprises a solenoid valve provided in the main body, wherein the solenoid valve comprises:

a valve body provided in the main body, the valve body being configured to generate magnetic fields by supplying power in a state in which the main body is stopped; and a shaft withdrawn from the valve body by the magnetic fields and passing through a bottom surface of the main body when being withdrawn so as to be inserted into the recess part.

16. The robot vacuum cleaner according to claim 15, wherein a gasket is disposed on an end portion of the shaft, and the gasket contacts a bottom surface of the recess part to cover the air hole in a state in which the shaft is inserted into the recess part.

17. The robot vacuum cleaner according to claim 15, wherein the shaft is disposed vertically above the recess part and has a movable shaft that is perpendicular to the recess part.

18. The robot vacuum cleaner according to claim 15, wherein a detection device configured to detect mounting of the water tank unit is provided in the main body, and when the main body is stopped in the state in which the water tank unit is mounted on the main body, power is supplied to the solenoid valve.

19. The robot vacuum cleaner according to claim 1, wherein a water injection hole configured to supply water into the filling space is formed in an end portion of one side on a top surface of the water tank unit, and the air inlet is disposed at a position adjacent to the water injection hole.

20. The robot vacuum cleaner according to claim 1, wherein at least a portion of the water supply unit is exposed to the inside of the filling space and a bottom surface of the water tank unit, the water supply unit absorbs water within the filling space to transfer the water to the damp cloth, and an amount of water to be supplied is controlled by adjusting an air pressure of the filling space through the opening and closing of the air hole.

* * * * *